US010745774B2

(12) United States Patent
Ishii et al.

(10) Patent No.: US 10,745,774 B2
(45) Date of Patent: Aug. 18, 2020

(54) FERRITE-MARTENSITE DUAL-PHASE STAINLESS STEEL AND METHOD OF MANUFACTURING THE SAME

(71) Applicant: JFE Steel Corporation, Tokyo (JP)

(72) Inventors: Tomohiro Ishii, Tokyo (JP); Hiroki Ota, Tokyo (JP); Chikara Kami, Tokyo (JP); Saiichi Murata, Tokyo (JP); Mitsuyuki Fujisawa, Tokyo (JP); Genichi Ishibashi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 835 days.

(21) Appl. No.: 15/033,291

(22) PCT Filed: Oct. 27, 2014

(86) PCT No.: PCT/JP2014/005425
§ 371 (c)(1),
(2) Date: Apr. 29, 2016

(87) PCT Pub. No.: WO2015/064077
PCT Pub. Date: May 7, 2015

(65) Prior Publication Data

US 2016/0289786 A1 Oct. 6, 2016

(30) Foreign Application Priority Data

Oct. 31, 2013 (JP) ..... 2013-226716
Apr. 24, 2014 (JP) ..... PCT/JP2014/062121

(51) Int. Cl.
*C21D 9/46* (2006.01)
*C21D 8/02* (2006.01)
(Continued)

(52) U.S. Cl.
CPC ..... *C21D 9/46* (2013.01); *C21D 6/004* (2013.01); *C21D 6/005* (2013.01); *C21D 6/008* (2013.01);
(Continued)

(58) Field of Classification Search
CPC ..... C21D 9/46; C21D 6/004; C21D 6/005; C21D 6/008; C21D 8/0226; C21D 8/0263;
(Continued)

(56) References Cited

U.S. PATENT DOCUMENTS 8,357,247 B2 * 1/2013 Hirasawa ..... C22C 38/001 148/310
2002/0009381 A1 * 1/2002 Yazawa ..... C22C 38/001 420/34
(Continued)

FOREIGN PATENT DOCUMENTS

CN 103233180 8/2013
CN 103320707 9/2013
(Continued)

OTHER PUBLICATIONS

Hirasawa et al., JP 2005-272938, machine translation. (Year: 2005).*
(Continued)

*Primary Examiner* — John A Hevey
(74) *Attorney, Agent, or Firm* — DLA Piper LLP (US)

(57) ABSTRACT

A ferrite-martensite dual-phase stainless steel has satisfactory corrosion resistance and workability for a material for the body of a freight car and excellent low-temperature toughness. The ferrite-martensite dual-phase stainless steel has a specified chemical composition, in which inequalities (I) and (II) below are satisfied, and a steel microstructure including a dual phase of a ferrite phase and a martensite phase, in which the content of the martensite phase is 5% or more and 95% or less in terms of vol. %:
(Continued)

$$10.5 \leq Cr+1.5 \times Si \leq 13.5 \quad (I)$$

$$1.5 \leq 30 \times (C+N)+Ni+0.5 \times Mn \leq 6.0 \quad (II),$$

where Cr and Si in inequality (I) above and C, N, Ni, and Mn in inequality (II) above respectively represent the contents (mass %) of the corresponding chemical elements.

12 Claims, 4 Drawing Sheets

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/28*** | (2006.01) |
| ***C22C 38/24*** | (2006.01) |
| ***C22C 38/58*** | (2006.01) |
| ***C22C 38/26*** | (2006.01) |
| ***C21D 6/00*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C21D 8/0226* (2013.01); *C21D 8/0263* (2013.01); *C22C 38/00* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/24* (2013.01); *C22C 38/26* (2013.01); *C22C 38/28* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 2211/004* (2013.01); *C21D 2211/005* (2013.01); *C21D 2211/008* (2013.01)

(58) Field of Classification Search
CPC ..... C21D 2211/005; C21D 2211/008; C21D 2211/004; C22C 38/50; C22C 38/46; C22C 38/48; C22C 38/54; C22C 38/52; C22C 38/008; C22C 38/26; C22C 38/24; C22C 38/001; C22C 38/44; C22C 38/42; C22C 38/28; C22C 38/06; C22C 38/04; C22C 38/02; C22C 38/005; C22C 38/004; C22C 38/002; C22C 38/00; C22C 38/58
See application file for complete search history.

(56) References Cited

U.S. PATENT DOCUMENTS

| | | | | |
|---|---|---|---|---|
| 2004/0096352 | A1 | 5/2004 | Ozaki et al. | |
| 2012/0125724 | A1* | 5/2012 | Yamauchi ..... | C21D 6/002 188/218 XL |

FOREIGN PATENT DOCUMENTS

| | | | |
|---|---|---|---|
| EP | 0 798 394 | | 10/1997 |
| EP | 1 717 328 | | 11/2006 |
| EP | 2 341 161 | | 7/2011 |
| EP | 2 434 030 | | 3/2012 |
| JP | 59-211526 | A | 11/1984 |
| JP | 61-136661 | A | 6/1986 |
| JP | 04-224657 | A | 8/1992 |
| JP | 5-156409 | | 6/1993 |
| JP | 11-302791 | A | 11/1999 |
| JP | 2000-144337 | | 5/2000 |
| JP | 2000-160300 | | 6/2000 |
| JP | 2000-328202 | | 11/2000 |
| JP | 2001-098348 | | 4/2001 |
| JP | 2001-279392 | A | 10/2001 |
| JP | 2003-003242 | A | 1/2003 |
| JP | 2004-131743 | A | 4/2004 |
| JP | 2005-272938 | A | 10/2005 |
| JP | 2006-249514 | | 9/2006 |
| JP | 2010-168646 | A | 8/2010 |
| JP | 2012-007195 | | 1/2012 |
| JP | 2012-012702 | A | 1/2012 |
| RU | 2 459 884 | | 8/2012 |
| RU | 2 494 166 | | 9/2013 |

OTHER PUBLICATIONS

Kumano et al., JP 2012-007195, machine translation. (Year: 2012).*
Russian Office Action dated Oct. 20, 2017, of corresponding Russian Application No. 2016121360/02, along with an English translation.
Korean Office Action dated Apr. 5, 2017, of corresponding Korean Application No. 10-2016-7014175, along with a Concise Statement of Relevance of Office Action in English.
Chinese Office Action dated Jan. 11, 2017, of corresponding Chinese Application No. 201480058519.3, along with a Concise Statement of Relevance of Office Action in English.
Supplementary European Search Report dated Sep. 7, 2016, of corresponding European Application No. 14859015.1.
Official Action dated Dec. 14, 2018, of related U.S. Appl. No. 14/778,291.

* cited by examiner

FERRITE-MARTENSITE DUAL-PHASE STAINLESS STEEL AND METHOD OF MANUFACTURING THE SAME

TECHNICAL FIELD

This disclosure relates to ferrite-martensite dual-phase stainless steel excellent in terms of low-temperature toughness suitably used as a material for the body of a freight car which carries, for example, coal or oil in cold areas and a method of manufacturing the steel.

The disclosure also relates to a ferrite-martensite dual-phase stainless steel to be used as a material for a welded structure excellent in terms of low-temperature toughness of a welded heat-affected zone suitably used as a structural material for a structure formed by welding.

BACKGROUND

As the length of railways increases globally, the amount of freight transportation by rail is increasing year by year. Freight cars such as railway wagons and containers are used for railway freight transportation, and ferritic stainless steel is nowadays used as a material for freight cars.

However, there is a problem in that ferritic stainless steel, which has insufficient low-temperature toughness, is not suitably used in cold areas in, for example, inland regions of the Eurasian Continent having an atmospheric temperature of −30° C. or lower in the winter. In particular, a material for the body of a freight car carrying liquids such as oil is required to have excellent low-temperature toughness.

Moreover, in ferritic stainless steel, there is a problem of further deterioration in the toughness of a welded heat-affected zone due to coarsening of grains. Therefore, in cold areas, it is difficult to use ferritic stainless steel in applications to a structure formed by welding.

As an example of stainless steel to be used for a railway wagon, Japanese Unexamined Patent Application Publication No. 2012-12702 discloses a stainless steel in which the corrosion resistance of a weld zone is improved by forming a martensite phase in a welded heat-affected zone and in which the occurrence of surface defects is suppressed by specifying an FFV value. However, that stainless steel has insufficient low-temperature toughness.

As an example of stainless steel sheet having excellent toughness, for example, Japanese Unexamined Patent Application Publication No. 11-302791 discloses a high-strength high-toughness stainless steel sheet having excellent bendability. In that high-strength high-toughness stainless steel sheet, bendability is improved by controlling the length of MnS-based inclusion particles in the rolling direction to be 3 μm or less and by controlling the ratio of the length in the rolling direction to the length in a direction at a right angle to the rolling direction of the MnS-based inclusion particles to be 3.0 or less. However, in JP '791, corrosion resistance, in particular, the corrosion resistance of a weld zone, which is required for a material for the body of a freight car, may be insufficient and further low-temperature toughness may be insufficient, in some cases.

Japanese Unexamined Patent Application Publication No. 61-136661 discloses a thick martensitic stainless steel having excellent toughness in which formation of δ ferrite is inhibited. However, since the strength of that stainless steel is excessively high, it is difficult to perform press forming on that stainless steel to use it for a railway wagon or a container for railway freight. In addition, in the stainless steel described in JP '661, low-temperature toughness may be insufficient in some cases.

In addition, as an example of a ferritic stainless steel having improved low-temperature toughness of a welded heat-affected zone, Japanese Unexamined Patent Application Publication No. 2003-3242 discloses a ferritic stainless steel having excellent toughness of a welded joint. However, coarsening of grains in a welded heat-affected zone is inhibited by causing fine Mg-based oxides to be dispersed and precipitated in steel.

Japanese Unexamined Patent Application Publication No. 4-224657 discloses a ferritic stainless steel having excellent toughness of a welded heat-affected zone. However, the toughness of a weld zone is improved by adding Co.

However, JP '242 and JP '657 are not sufficient to provide toughness of a welded heat-affected zone to be used in a cold area having an atmospheric temperature of −30° C. or lower.

As described above, the stainless steels described above are not suitable as a material for a freight car carrying liquids such as oil in a cold area because of their insufficient low-temperature toughness. In addition, the stainless steels disclosed above do not have satisfactory corrosion resistance or workability which is required for a material for the body of a freight car.

Moreover, since there is a further deterioration in the low-temperature toughness of a welded heat-affected zone, those stainless steels are not suitably used in applications in which a structure is formed by welding.

It could therefore be helpful to provide a ferrite-martensite dual-phase stainless steel having satisfactory corrosion resistance and workability required for a material for the body of a freight car, and having excellent low-temperature toughness and to provide a method of manufacturing the stainless steel.

In addition, it could also be helpful to provide a ferrite-martensite dual-phase stainless steel to be used as a material for a welded structure excellent in terms of the low-temperature toughness of a welded heat-affected zone in addition to the properties described above and a method of manufacturing the stainless steel.

SUMMARY

We thus provide:

(1) A ferrite-martensite dual-phase stainless steel, the steel having a chemical composition containing, by mass %, C: 0.005% or more and 0.030% or less, N: 0.005% or more and 0.030% or less, Si: 0.05% or more and 1.00% or less, Mn: 0.05% or more and 2.5% or less, P: 0.04% or less, S: 0.02% or less, Al: 0.01% or more and 0.15% or less, Cr: 10.0% or more and 13.0% or less, Ni: 0.3% or more and 5.0% or less, V: 0.005% or more and 0.10% or less, Nb: 0.05% or more and 0.4% or less, Ti: 0.1% or less, and the balance being Fe and inevitable impurities, in which inequalities (I) and (II) below are satisfied and a steel microstructure including a dual phase of a ferrite phase and a martensite phase, the content of the martensite phase being 5% or more and 95% or less in terms of vol. %:

$$10.5 \leq Cr + 1.5 \times Si \leq 13.5 \quad (I)$$

$$1.5 \leq 30 \times (C+N) + Ni + 0.5 \times Mn \leq 6.0 \quad (II)$$

where Cr and Si in inequality (I) above and C, N, Ni, and Mn in inequality (II) above respectively represent the contents (mass %) of the corresponding chemical elements.

(2) The ferrite-martensite dual-phase stainless steel according to item (1), in which the steel has the chemical composition further containing, by mass %, one, two, or more of Cu: 1.0% or less, Mo: 1.0% or less, W: 1.0% or less, and Co: 0.5% or less.

(3) The ferrite-martensite dual-phase stainless steel according to item (1) or (2), in which the steel has the chemical composition further containing, by mass %, one, two, or more of Ca: 0.01% or less, B: 0.01% or less, Mg: 0.01% or less, and REM: 0.05% or less.

(4) The ferrite-martensite dual-phase stainless steel according to item (1), in which, by mass %, the N content is 0.005% or more and 0.015% or less, the Si content is 0.05% or more and 0.50% or less, the Mn content is more than 1.0% and 2.5% or less, the Ni content is 0.3% or more and less than 1.0%, the Nb content is 0.05% or more and 0.25% or less, and the Ti content is 0.02% or less, and in which relational expression (III) below is satisfied:

$$2600C+1700N-20Si+20Mn-40Cr+50Ni+1660 \geq 1270 \quad \text{(III)}$$

where C, N, Si, Mn, Cr, and Ni in relational expression (III) respectively represent the contents (mass %) of the corresponding chemical elements.

(5) The ferrite-martensite dual-phase stainless steel according to item (4), in which, by mass %, the P content is less than 0.02%.

(6) The ferrite-martensite dual-phase stainless steel according to item (4) or (5), in which the steel has the chemical composition further containing, by mass %, one, two, or more of Cu: 1.0% or less, Mo: less than 0.5%, W: 1.0% or less, and Co: 0.5% or less.

(7) The ferrite-martensite dual-phase stainless steel according to any one of items (4) to (6), in which the steel has the chemical composition further containing, by mass %, one, two, or more of Ca: 0.01% or less, B: 0.01% or less, Mg: 0.01% or less, and REM: 0.05% or less.

(8) A method of manufacturing ferrite-martensite dual-phase stainless steel, the method being a method of manufacturing the ferrite-martensite dual-phase stainless steel according to any one of items (1) to (7), and the method including heating a steel slab to a temperature of 1100° C. or higher and 1300° C. or lower, then performing hot rolling including hot rough rolling in which at least one rolling pass is performed with a rolling reduction of 30% or more in a temperature range higher than 900° C., and then performing annealing at a temperature of 700° C. or higher and 900° C. or lower for one hour or more.

It is possible to obtain a ferrite-martensite dual-phase stainless steel having satisfactory corrosion resistance, workability and excellent low-temperature toughness required for a material for the body of a freight car carrying, for example, coal or oil in cold areas and to obtain a method of manufacturing the steel.

Moreover, it is possible to obtain a ferrite-martensite dual-phase stainless steel excellent in terms of low-temperature toughness of a welded heat-affected zone in addition to having the properties described above which can suitably be used as a material for a welded structure also.

In addition, it is possible to manufacture the ferrite-martensite dual-phase stainless steel having excellent properties described above at low cost and with high efficiency.

DETAILED DESCRIPTION

Our steels and methods will be described in detail hereafter. This disclosure is not limited to the examples described below.

Figure 1:
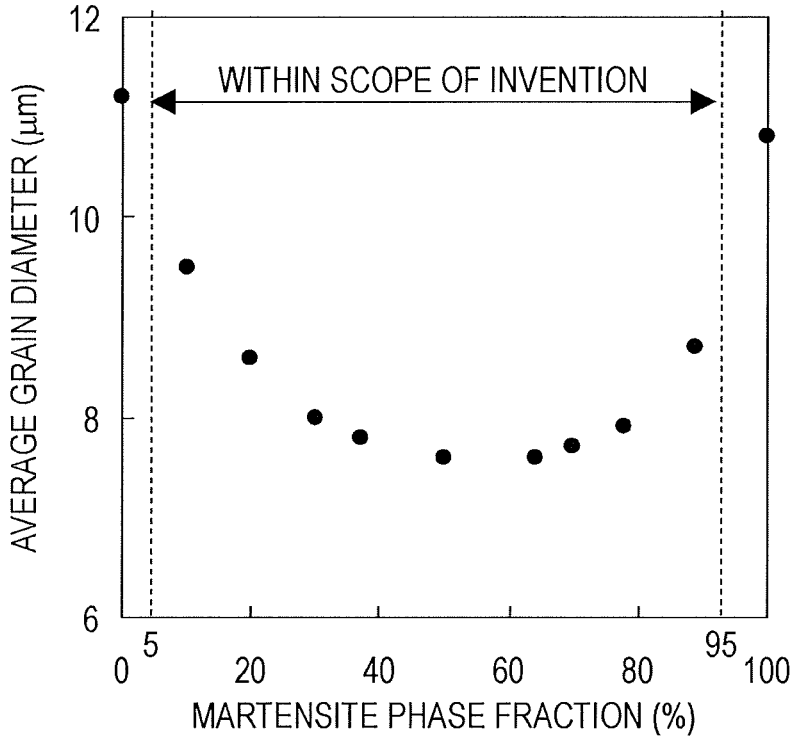
FIG. 1 is a diagram illustrating the influence of a martensite phase fraction on an average grain diameter.

As a method of evaluating the influence of a microstructure on low-temperature toughness, one using the Hall-Petch law, which expresses the correlation between grain diameter and low-temperature toughness, is known. According to Hall-Petch, a ductile-brittle transition temperature decreases in proportion to grain diameter raised to the power of negative ½. That is, the smaller the grain diameter, the higher the low-temperature toughness. On the basis of this knowledge, we conducted investigations regarding chemical composition and a manufacturing method to decrease the grain diameter of stainless steel. FIG. 1 illustrates the correlation between a martensite phase fraction (the content of a martensite phase expressed in units of vol. %) and an average grain diameter in stainless steel having a chemical composition within our range. We found that, when the martensite phase fraction is 5% to 95%, average grain diameter is small. Therefore, it is possible to improve low-temperature toughness through minimizing the average grain diameter. A method of determining the average grain diameter is as described in the EXAMPLES.

It is possible to control a martensite phase fraction by controlling a Cr equivalent ($Cr+1.5\times Si$) and a Ni equivalent ($30\times(C+N)+Ni+0.5\times Mn$), and by controlling annealing temperature. It is possible to obtain ferrite-martensite dual-phase stainless steel having a small average grain diameter and excellent low-temperature toughness by controlling these parameters.

We also found, as a result of close observation, the microstructure of the welded heat-affected zone of stainless steel having a poor low-temperature toughness of the welded heat-affected zone, coarse crystal grains called δ ferrite having a grain diameter of 50 μm or more, which is formed in a temperature range of about 1300° C. or higher. On the other hand, in stainless steel having excellent low-temperature toughness of a welded heat-affected zone, coarse δ ferrite was not found, but a fine microstructure in which martensite is dispersed was found. That is, we believe that suppressing formation of coarse δ ferrite is effective in improving the low-temperature toughness of a welded heat-affected zone.

Figure 2:
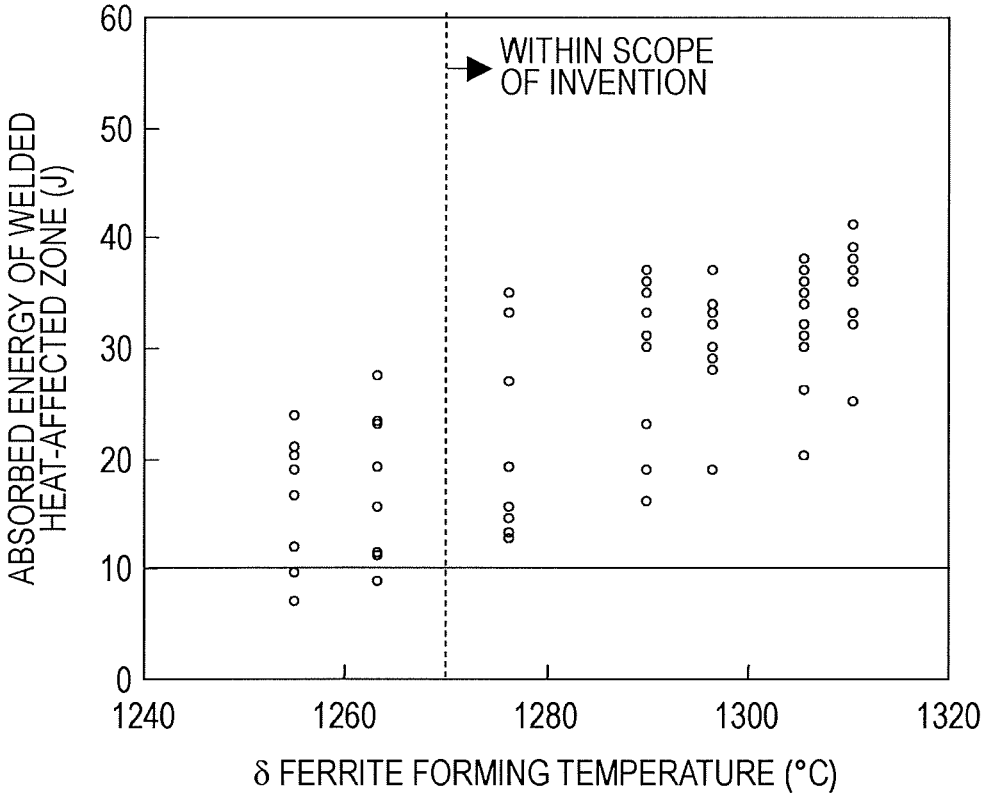
FIG. 2 is a diagram illustrating the influence of a δ ferrite forming temperature on the absorbed energy of a welded heat-affected zone.

We, therefore, conducted close investigations regarding the influence of the constituent chemical elements of stainless steel on a δ ferrite forming temperature and clarified that a δ ferrite forming temperature is expressed by the left-hand side of relational expression (III). Regarding samples prepared to contain Ti in an amount of 0.01% and other constituent chemical elements in appropriate amounts, each absorbed energy of a welded heat-affected zone in a Charpy impact test (testing temperature: −50° C., test piece thickness: 5 mm) was plotted against the δ ferrite forming temperature indicated along the horizontal axis. The results are illustrated in FIG. 2. Although the value of the absorbed energy of a welded heat-affected zone varies widely from test to test, the minimum value of the absorbed energy of a welded heat-affected zone increases with increasing δ ferrite forming temperature. When the δ ferrite forming temperature is 1270° C. or higher, the minimum value of the absorbed energy is 10 J or more, which means that satisfactory low-temperature toughness of a welded heat-affected zone is achieved:

$$2600C+1700N-20Si+20Mn-40Cr+50Ni+1660\geq 1270 \quad \text{(III)}.$$

Atomic symbols in relational expression (III) respectively represent the contents (mass %) of the corresponding chemical elements.

Figure 3:
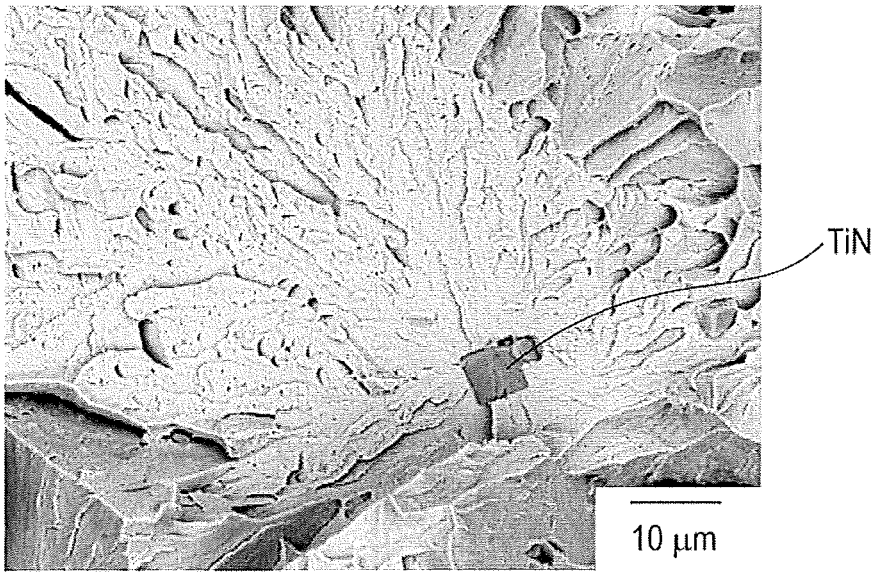
FIG. 3 is a diagram indicating a fracture surface of a fracture originating from TiN.
Figure 4:
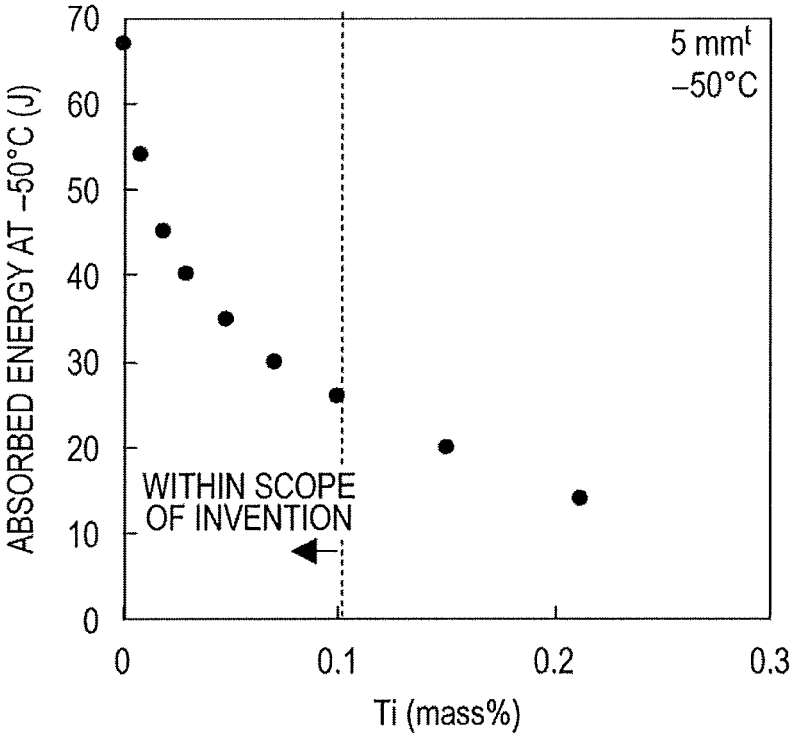
FIG. 4 is a diagram illustrating the influence of the Ti content on low-temperature toughness.

Moreover, regarding factors from which a fracture originates at a low temperature, we found that a fracture originates from a coarse inclusion such as TiN. FIG. 3 illustrates an example of the fracture surface of a fracture originating from TiN. We found that a river pattern was formed around TiN and that a brittle fracture originating from TiN occurred. As long as conditions for a chemical composition are satisfied, it is possible to control, by controlling the Ti content, the amount and size of TiN formed. FIG. 4 illustrates the influence of the Ti content on low-temperature toughness when chemical composition and a martensite phase fraction are within our ranges. Each value of absorbed energy in FIG. 4 was defined as the average value of absorbed energy determined by performing a Charpy test three times. We also found that low-temperature toughness improves with decreasing Ti content. We believe that there is an improvement in low-temperature toughness because the number of fracture origins decreases as the number of TiN formed decreases with decreasing Ti content.

Figure 5:
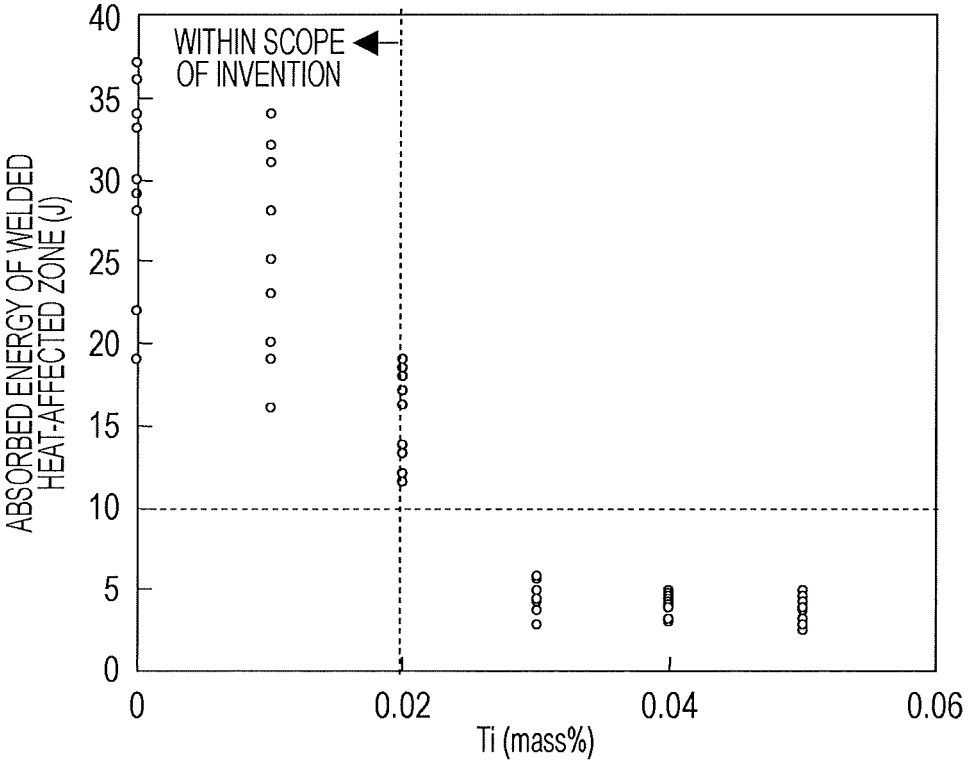
FIG. 5 is a diagram illustrating the influence of the Ti content on the absorbed energy of a welded heat-affected zone.

In addition, we conducted a Charpy impact test (testing temperature: −50° C., test piece thickness: 5 mm) on a welded heat-affected zone, and found that there is an improvement in the low-temperature toughness of the welded heat-affected zone by strictly controlling the Ti content to be 0.02% or less, which causes the number of fracture origins to decrease in the welded heat-affected zone. FIG. 5 illustrates the influence of the Ti content on the absorbed energy of a welded heat-affected zone. The δ ferrite forming temperature of the samples used was controlled to 1270° C. to 1290° C. When the Ti content was 0.02 mass % or less, the minimum value of the absorbed energy of the welded heat-affected zone was 10 J or more, which means that satisfactory low-temperature toughness of the welded heat-affected zone was achieved. A coarse TiN has a stronger influence on absorbed energy in a welded heat-affected zone than in a hot-rolled and annealed steel sheet. This is believed to be because, since there is a larger increase in grain diameter in a welded heat-affected zone than in a hot-rolled and annealed steel sheet, a small number of fracture origins have a larger influence on a decrease in absorbed energy in a welded heat-affected zone than in a hot-rolled and annealed steel sheet.

The chemical composition of the ferrite-martensite dual-phase stainless steel (hereinafter, also referred to as "stainless steel") will be described. In the description below, % used when describing the contents of the constituent chemical elements represents mass %, unless otherwise noted.

C: 0.005% or More and 0.030% or Less and N: 0.005% or More and 0.030% or Less

C and N are austenite stabilizing chemical elements. When there is an increase in the contents of C and N, there is a tendency for a martensite phase fraction in the stainless steel to increase. In this manner, C and N are chemical elements effective to control a martensite phase fraction. Such an effect is realized when the C content and the N content are respectively 0.005% or more. However, C and N are chemical elements that deteriorate the toughness of a martensite phase. Therefore, it is appropriate that the C content and the N content be respectively 0.030% or less. Therefore, the contents of C and N are respectively 0.005% or more and 0.030% or less, or preferably respectively 0.008% or more and 0.020% or less.

C and N are effective in inhibiting an increase in grain diameter as a result of forming martensite also in a welded heat-affected zone. However, it is necessary that formation of TiN be inhibited more strictly in a welded heat-affected zone than in other zones to achieve satisfactory low-temperature toughness. When the N content is more than 0.015%, formation of TiN is promoted. Therefore, to achieve satisfactory low-temperature toughness of a welded heat-affected zone, it is necessary that the N content be 0.005% or more and 0.015% or less, or preferably 0.008% or more and 0.012% or less.

Si: 0.05% or More and 1.00% or Less

Si is a chemical element used as a deoxidation agent. It is necessary that the Si content be 0.05% or more to produce such an effect. In addition, since Si is a ferrite stabilizing chemical element, there is a tendency for a martensite phase fraction to decrease with increasing Si content. Therefore, Si is a chemical element effective to control a martensite phase fraction. On the other hand, when the Si content is more than 1.00%, since a ferrite phase becomes brittle, there is a deterioration in toughness. Therefore, the Si content is 0.05% or more and 1.00% or less, or preferably 0.11% or more and 0.40% or less.

In addition, Si is a chemical element that deteriorates the low-temperature toughness of a welded heat-affected zone as a result of decreasing a δ ferrite forming temperature in a welded heat-affected zone. Therefore, to achieve satisfactory low-temperature toughness of a welded heat-affected zone, it is necessary that the Si content be controlled more strictly than in other zones. When the Si content is more than 0.50%, it is difficult to inhibit formation of δ ferrite in a welded heat-affected zone. Therefore, to achieve satisfactory low-temperature toughness of a welded heat-affected zone, the Si content is 0.05% or more and 0.50% or less, or preferably 0.11% or more and 0.40% or less.

Mn: 0.05% or More and 2.5% or Less

Mn is an austenite stabilizing chemical element and, when there is an increase in the Mn content, there is an increase in martensite phase fraction in stainless steel. Such an effect is obtained when the Mn content is 0.05% or more. However, when the Mn content of the stainless steel is more than 2.5%, the above-described effect produced by adding Mn becomes saturated, there is a deterioration in toughness, and there is a negative effect on surface quality due to a deterioration in descaling performance in a manufacturing process. Moreover, when the Mn content is more than 2.5%, since formation of MnS, which is the source of corrosion, is promoted, there is a deterioration in corrosion resistance. Therefore, the Mn content is 0.05% or more and 2.5% or less, or preferably 0.11% or more and 2.0% or less.

In addition, Mn is a chemical element that refines the microstructure of a welded heat-affected zone by increasing a δ ferrite forming temperature in a welded heat-affected zone. Therefore, to achieve satisfactory low-temperature toughness of a welded heat-affected zone, it is necessary that the Mn content be more strictly controlled than in other zones. When the Mn content is 1.0% or less, it is difficult to inhibit formation of δ ferrite in a welded heat-affected zone. Therefore, to achieve satisfactory low-temperature toughness of a welded heat-affected zone, the Mn content is more than 1.0% and 2.5% or less, or preferably 1.2% or more and 2.0% or less.

P: 0.04% or Less

It is preferable that the P content be small from the viewpoint of hot workability. The maximum acceptable P content is 0.04%, or preferably 0.035%.

Moreover, when there is a decrease in P content, there is a significant improvement in low-temperature toughness of a welded heat-affected zone. We believe it is because the propagation of a crack is inhibited due to a decrease in the amount of impurities. Such an effect is realized when the P content is reduced to being less than 0.02%. Therefore, it is more preferable that the maximum value of the P content be less than 0.02%.

S: 0.02% or Less

It is preferable that the S content be small from the viewpoint of hot workability and corrosion resistance. The maximum acceptable S content is 0.02%, or preferably 0.005%.

Al: 0.01% or More and 0.15% or Less

Al is a chemical element generally effective for deoxidization. Such an effect is produced when the Al content is 0.01% or more. On the other hand, when the Al content is more than 0.15%, large-size Al-based inclusions are formed, which results in surface defects. Therefore, the Al content is 0.01% or more and 0.15% or less, or preferably 0.03% or more and 0.14% or less.

Cr: 10.0% or More and 13.0% or Less

Since Cr forms a passivation film, Cr is a chemical element indispensable in achieving satisfactory corrosion resistance. It is necessary that the Cr content be 10.0% or more to achieve such an effect. In addition, since Cr is a ferrite stabilizing chemical element, Cr is a chemical element effective in controlling a martensite phase fraction. However, when the Cr content is more than 13.0%, there is an increase in the manufacturing costs of stainless steel, and it is difficult to obtain a sufficient martensite phase fraction. Therefore, the Cr content is 10.0% or more and 13.0% or less, or preferably 10.5% or more and 12.5% or less.

Ni: 0.3% or More and 5.0% or Less

Since Ni is, like Mn, an austenite stabilizing chemical element, Ni is a chemical element effective to control a martensite phase fraction. Such an effect is achieved when the Ni content is 0.3% or more. However, when the Ni content is more than 5.0%, since it is difficult to control a martensite phase fraction, there is a deterioration in toughness and workability. Therefore, the Ni content is 0.3% or more and 5.0% or less.

Ni is a chemical element that refines a microstructure by increasing a δ ferrite forming temperature in a welded heat-affected zone. Such an effect is obtained when the Ni content is 0.3% or more. However, when the Ni content is 1.0% or more, since there is an increase in the hardness of a welded heat-affected zone, there is conversely a deterioration in the low-temperature toughness of a welded heat-affected zone. Therefore, the Ni content is 0.3% or more and less than 1.0%, or preferably 0.4% or more and 0.9% or less.

V: 0.005% or More and 0.10% or Less.

V is a chemical element that inhibits deterioration in the toughness of a martensite phase as a result of forming nitrides. Such an effect is achieved when the V content is 0.005% or more. However, when the V content is more than 0.10%, since V is concentrated just under the temper color of a weld zone, there is deterioration in corrosion resistance. Therefore, the V content is 0.005% or more and 0.10% or less, or preferably 0.01% or more and 0.06% or less.

Nb: 0.05% or More and 0.4% or Less

Nb is effective in inhibiting formation of the carbonitrides and the like of Cr by fixing C and N in steel as a result of precipitating C and N in the form of the carbides, nitrides or carbonitrides of Nb. Nb is a chemical element that improves corrosion resistance, in particular, the corrosion resistance of a weld zone. Such effects are obtained when the Nb content is 0.05% or more. On the other hand, when the Nb content is more than 0.4%, there is a deterioration in hot workability, there is an increase in hot rolling load, and it is difficult to perform annealing at a temperature at which an appropriate austenite phase fraction is achieved due to an increase in the recrystallization temperature of a hot-rolled steel sheet. Therefore, the Nb content is 0.05% or more and 0.4% or less, or preferably 0.10% or more and 0.30% or less.

When the Nb content is more than 0.25%, since excessive amounts of C and N are fixed in the form of carbonitrides and the like in a welded heat-affected zone, an increase in the grain diameter of δ ferrite is promoted because formation of martensite is inhibited in a welded heat-affected zone, which results in a deterioration in low-temperature toughness. Therefore, the Nb content is 0.05% or more and 0.25% or less, preferably 0.10% or more and 0.20% or less.

Ti: 0.1% or Less

Ti is, like Nb, effective to inhibit formation of the carbonitrides and the like of Cr by fixing C and N in steel as a result of precipitating C and N in the form of the carbides, nitrides, or carbonitrides of Ti. We found that there is a deterioration in low-temperature toughness due to a fracture originating from a coarse TiN among the precipitates. Decreasing the number of such coarse TiN to decrease the number of fracture origins is an important characteristic. With this, it is possible to obtain stainless steel more excellent in terms of low-temperature toughness comparing with that having the same average grain diameter of a ferrite-martensite microstructure. In particular, when the Ti content is more than 0.1%, there is a significant deterioration in toughness due to TiN. When the Ti content is more than 0.1%, we believe that, since the number density of TiN having a side length of 1 μm or more is more than 70 particles/mm$^2$, there is a deterioration in toughness due to such TiN. Therefore, the Ti content is 0.1% or less, preferably 0.04% or less, or more preferably 0.02% or less. Since it is preferable that the Ti content be as small as possible, the lower limit of the Ti content is 0%. In addition, it is appropriate that the number density of TiN having a side length of 1 μm or more be 70 particles/mm$^2$ or less, or preferably 40 particles/mm$^2$ or less.

Since grain diameter is larger in a welded heat-affected zone than in a hot-rolled and annealed steel sheet, there may be a significant deterioration in low-temperature toughness due to the presence of only a small number of fracture origins. It is necessary that the Ti content be strictly limited to 0.02% or less to achieve sufficient low-temperature toughness of a welded heat-affected zone by inhibiting formation of coarse TiN. Therefore, it is preferable that the Ti content be 0.02% or less, or more preferably 0.015% or less.

The stainless steel contains the constituent chemical elements described above and the balance being Fe and inevitable impurities. Specific examples of the inevitable impurities include Zn: 0.03% or less and Sn: 0.3% or less.

In addition, the stainless steel may further contain, by mass %, one, two, or more of Cu: 1.0% or less, Mo: 1.0% or less, W: 1.0% or less, and Co: 0.5% or less in addition to the constituent chemical elements described above.

Cu: 1.0% or Less

Cu is a chemical element that improves corrosion resistance and, in particular, prevents crevice corrosion. Therefore, when the stainless steel is used in applications in which high corrosion resistance is required, it is preferable that Cu be added. However, when the Cu content is more than 1.0%, there is a deterioration in hot workability. In addition, when the Cu content is more than 1.0%, since it is difficult to control the martensite phase fraction due to an increase in the amount of an austenite phase at a high temperature, it is difficult to achieve excellent low-temperature toughness. Therefore, when Cu is added to the stainless steel, the upper limit of the Cu content is 1.0%. In addition, it is preferable that the Cu content be 0.3% or more to sufficiently achieve the effect of improving corrosion resistance. It is more preferable that the Cu content be 0.3% or more and 0.5% or less.

Mo: 1.0% or Less

Mo is a chemical element that improves corrosion resistance. Therefore, when the stainless steel is used in applications in which high corrosion resistance is required, it is preferable that Mo be added to the stainless steel. However, when the Mo content is more than 1.0%, there is a deterioration in workability in cold rolling, and there is a significant deterioration in surface quality due to rough surface occurring in a hot rolling process. Therefore, when Mo is added to the stainless steel, it is preferable that the upper limit of the Mo content be 1.0%. In addition, it is effective to add Mo in an amount of 0.03% or more to sufficiently produce the effect of improving corrosion resistance. It is more preferable that the Mo content be 0.10% or more and 0.80% or less.

Adding Mo promotes formation of coarse δ ferrite in the welded heat-affected zone. It is preferable that the Mo content be less than 0.5% to achieve satisfactory low-temperature toughness of a welded heat-affected zone.

W: 1.0% or Less

W is a chemical element that improves corrosion resistance. Therefore, when the stainless steel is used in applications in which high corrosion resistance is required, it is preferable that W be added to the stainless steel. Such an effect is obtained when the W content is 0.01% or more. However, when the W content is excessively large, since there is an increase in strength, there is a deterioration in manufacturability. Therefore, the W content is 1.0% or less.

Co: 0.5% or Less

Co is a chemical element that improves toughness. Therefore, when the stainless steel is used in applications in which high toughness is particularly required, it is preferable that Co be added to the stainless steel. Such an effect is obtained when the Co content is 0.01% or more. However, when the Co content is excessively large, there is a deterioration in manufacturability. Therefore, the Co content is 0.5% or less.

In addition, the stainless steel may further contain, by mass %, one, two, or more of Ca: 0.01% or less, B: 0.01% or less, Mg: 0.01% or less, and REM: 0.05% or less in addition to the constituent chemical elements described above.

Ca: 0.01% or Less

Ca is a chemical element that suppresses nozzle clogging which tends to occur due to the precipitation of Ti-based inclusions when continuous casting is performed. Such an effect is realized when the Ca content is 0.0001% or more. However, when the Ca content is excessively large, since CaS which is a water-soluble inclusion is formed, there is a deterioration in corrosion resistance. Therefore, it is preferable that the Ca content be 0.01% or less.

B: 0.01% or Less

Since B is a chemical element that improves secondary working brittleness, the B content is 0.0001% or more to obtain such an effect. However, when the B content is excessively large, there is a deterioration in ductility due to solid solution strengthening. Therefore, the B content is 0.01% or less.

Mg: 0.01% or Less

Mg is a chemical element that contributes to an improvement in workability by increasing the equiaxial crystal ratio of a slab. Such an effect is obtained when the Mg content is 0.0001% or more. However, when the Mg content is excessively large, there is a deterioration in the surface quality of steel. Therefore, the Mg content is 0.01% or less.

REM: 0.05% or Less

REM is a chemical element that inhibits formation of oxidized scale by improving oxidation resistance. Among REM, in particular, La and Ce are effectively used to inhibit formation of oxidized scale. Such an effect is achieved when the REM content is 0.0001% or more. However, when the REM content is excessively large, there is a deterioration in manufacturability such as pickling performance, and there is an increase in manufacturing costs. Therefore, the REM content is 0.05% or less.

Hereafter, the steel microstructure of the ferrite-martensite dual-phase stainless steel will be described. % used when describing the contents of phases included in a steel microstructure represents vol. %.

Content of a Martensite Phase: 5% or More and 95% or Less in Terms of Vol. %

In the stainless steel, there is an improvement in low-temperature toughness because there is a decrease in grain diameter as a result of a martensite phase being included. As FIG. 1 illustrates, when the content of a martensite phase is, by vol. %, less than 5% or more than 95%, since an average grain diameter is more than 10.0 μm, it is not possible to expect an improvement in toughness due to a decrease in grain diameter. Therefore, the content of a martensite phase is set to be, by vol. %, 5% or more and 95% or less, preferably 15% or more and 90% or less, or more preferably 30% or more and 80% or less. When the content of a martensite phase is 30% or more and 80% or less, as FIG. 1 illustrates, since there is a significant decrease in average grain diameter, it is possible to realize a significant improvement in low-temperature toughness.

Controlling the content of a martensite phase is realized by controlling an annealing temperature and an austenite phase fraction (the content of an austenite phase expressed in units of vol. %) at the annealing temperature. By performing annealing at an appropriate temperature condition on a microstructure composed of a ferrite phase and a martensite phase after hot rolling has been performed, a part of the martensite phase reversely transforms into an austenite phase and there is a decrease in grain diameter, and then in a cooling process following the annealing process, the austenite phase again transforms into a martensite phase, forming grains having a further decreased grain diameter. All of the austenite phase present at the annealing temperature transforms into a martensite phase in the following cooling process. An appropriate austenite phase fraction at the annealing temperature is 5% or more and 95% or less.

When the austenite phase fraction is excessively small at the annealing temperature, since the amount of the reverse-transformed austenite is small, there is an insufficient effect of decreasing a grain diameter. When the austenite phase fraction is excessively large at the annealing temperature, since the grain growth of the reverse-transformed austenite phase occurs, it is not possible to obtain fine grains.

$$10.5 \leq Cr+1.5\times Si \leq 13.5 \quad \text{(I)},$$

$$1.5 \leq 30\times(C+N)+Ni+0.5\times Mn \leq 6.0 \quad \text{(II)}$$

It is possible to control a martensite phase fraction (the content of a martensite phase) by controlling a so-called Cr equivalent (Cr+1.5×Si) and a Ni equivalent (30×(C+N)+Ni+0.5×Mn). The ranges of the Cr equivalent and the Ni equivalent are respectively specified by establishing relational expression (I) using the Cr equivalent and relational expression (II) using the Ni equivalent. When the Cr equivalent is less than 10.5, since the Cr equivalent is too small, it is difficult to control the Ni equivalent by which a martensite phase fraction is controlled to be within the appropriate range. On the other hand, when the Cr equivalent in relational expression (I) is more than 13.5, since the Cr equivalent is excessively large, it is difficult to achieve an appropriate martensite phase fraction even if the Ni equivalent is increased. Therefore, the Cr equivalent in relational expression (I) is 10.5 or more and 13.5 or less, or preferably 11.0 or more and 12.5 or less. In the same manner, when the Ni equivalent is less than 1.5 or more than 6.0, it is difficult to achieve an appropriate martensite phase fraction. Therefore, the Ni equivalent in relational expression (II) is 1.5 or more and 6.0 or less, or preferably 2.0 or more and 5.0 or less.

Although, as described above, the steel microstructure of stainless steel includes a dual phase of ferrite and martensite, other phases may be included as long as the desired effect is not deteriorated. Examples of the other phases include an austenite phase and a σ phase. We believe that there is no deterioration in the desired effect when the sum of the contents of the other phases is 10% or less, or preferably 7% or less, in terms of volume fraction.

$$2600C+1700N-20Si+20Mn-40Cr+50Ni+1660 \geq 1270 \quad \text{(III)}$$

Formation of coarse δ ferrite in a welded heat-affected zone is controlled by controlling a δ ferrite forming temperature represented by the left-hand side of relational expression (III). This is because it is difficult to precisely control the δ ferrite forming temperature by controlling a so-called Cr equivalent or Ni equivalent.

Figure 6:
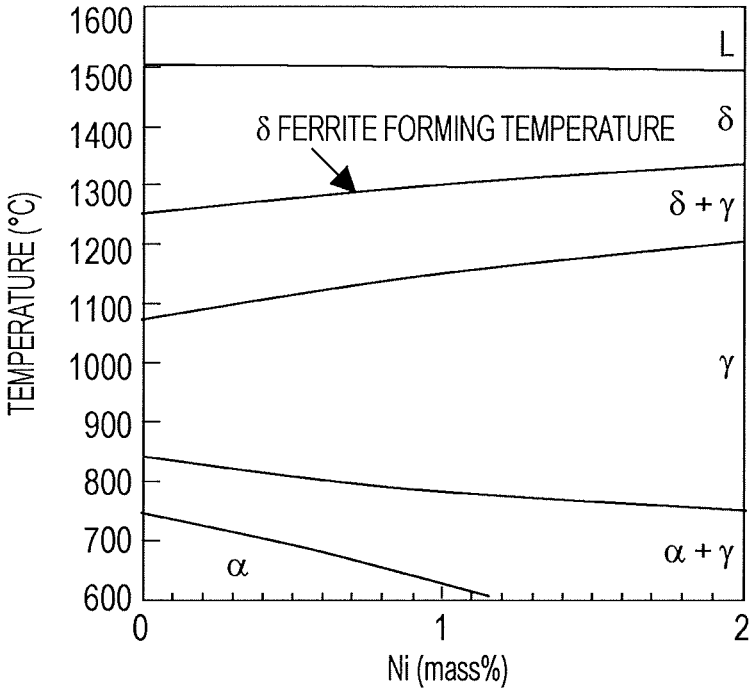
FIG. 6 is a diagram illustrating an example of the phase diagram of our steel.

FIG. 6 illustrates an example of the phase diagram (calculated by using calculating software Thermo-Calc produced by Thermo-Calc Software AB) of the steel (C: 0.01%, Si: 0.2%, Mn: 2.0%, Cr: 12%, Nb: 0.2%, and N: 0.01%). A δ ferrite forming temperature is about 1300° C. When a welded heat-affected zone is held at a temperature equal to or higher than this temperature for a long time, there is an increase in the grain diameter of δ ferrite in the welded heat-affected zone. Since ordinary Cr equivalent and Ni equivalent are established on the basis of the influences of constituent chemical elements at a temperature around an annealing temperature, it is not possible to use these parameters to assess the ease of formation of δ ferrite at such a high temperature to which a welded heat-affected zone is exposed. Therefore, by deriving the influence of each of the constituent chemical elements on a δ ferrite forming temperature from the phase diagram regarding each chemical element, the left-hand side of relational expression (III) was established. As FIG. 2 illustrates, when the δ ferrite forming temperature was higher than 1270° C., the minimum value of the absorbed energy of a welded heat-affected zone was 10 J or more, which means that satisfactory low-temperature toughness was achieved. The grain diameter of δ ferrite formed in the welded heat-affected zone having satisfactory low-temperature toughness was 50 μm or less at most. Therefore, inequality (III) was established with the right-hand side of relational expression (III) being assigned a value of 1270.

Hereafter, the method of manufacturing the stainless steel will be described.

A recommended method of manufacturing the stainless steel with high efficiency is a method including manufacturing a slab from molten steel prepared to have the chemical composition described above by using, for example, a continuous casting method, manufacturing a hot-rolled coil from this slab, annealing the hot-rolled coil, and then descaling the annealed hot-rolled coil (by using, for example, shot blasting or pickling) to obtain stainless steel. The method will be specifically described hereafter.

First, molten steel is prepared to have the chemical composition by using a known ordinary melting furnace such as a converter or an electric furnace, the molten steel is refined by using a known refining method such as a vacuum degassing method (RH (Ruhrstahl-Heraeus) method), a VOD (Vacuum Oxygen Decarburization) method, or an AOD (Argon Oxygen Decarburization) method, and then, the refined molten steel is cast into a steel slab (steel material) by using a continuous casting method or an ingot casting-slabbing method. Among the casting methods, it is preferable to use a continuous casting method from the viewpoint of productivity and material quality. In addition, it is preferable that a slab thickness be 100 mm or more, or more preferably, 200 mm or more, to ensure sufficient hot rough rolling reduction described below.

As described above, limiting the Ti content to 0.02% or less is an indispensable condition to achieve satisfactory low-temperature toughness of a welded heat-affected zone. Since the content of Ti mixed into steel as an inevitable impurity may be more than 0.02% when an ordinary melting method is used, it is necessary to use a melting method strictly controlling Ti being mixed into steel. Specifically, it is necessary to avoid using scrap, or, if scrap is used, it is necessary to control total Ti content of the scrap by analyzing the Ti content of the scrap. Moreover, it is necessary to avoid using the same melting furnace immediately after a steel grade containing Ti has been melted.

Subsequently, the steel slab is heated to a temperature of 1100° C. or higher and 1300° C. or lower, and then, the heated slab is hot-rolled into a hot-rolled steel sheet. It is preferable that the slab heating temperature be as high as possible to prevent the surface roughening of a hot-rolled steel sheet. However, when the slab heating temperature is higher than 1300° C., there is a manufacturing problem due to a significant change in slab shape caused by creep deformation, and there is a deterioration in the toughness of the hot-rolled steel sheet due to coarsening of grains. On the other hand, when the slab heating temperature is lower than 1100° C., there is an increase in hot rolling load, there is a significant surface roughening in hot rolling, and there is a deterioration in the toughness of the hot-rolled steel sheet due to insufficient recrystallization during hot rolling.

In a hot rough rolling process included in hot rolling, at least one rolling pass is performed with a rolling reduction of 30% or more in a temperature range higher than 900° C., or preferably a rolling reduction of 32% or more in a temperature range higher than 920° C.

By performing this high reduction rolling, since the grains of diameter of a steel sheet are refined, there is an improvement in toughness. After hot rough rolling has been performed, finish rolling is performed by using an ordinary method.

The hot-rolled steel sheet having a thickness of about 2.0 mm to 8.0 mm which has been manufactured by performing hot rolling is annealed at a temperature of 700° C. or higher and 900° C. or lower. After that, pickling may be performed. When the annealing temperature of a hot-rolled steel sheet is lower than 700° C., since there is an insufficient recrystallization, and since there is a decrease in the amount of reverse-transformed austenite because the reverse transformation from a martensite phase to an austenite phase is less likely to occur, it is not possible to achieve sufficient low-temperature toughness. On the other hand, when the annealing temperature of a hot-rolled steel sheet is higher than 900° C., since only an austenite phase is formed after annealing has been performed, and since there is a significant coarsening of grains, there is a deterioration in toughness. It is preferable that the annealing of a hot-rolled steel sheet be performed by using a so-called "box annealing" method holding a steel sheet for one hour or more. It is more preferable that the annealing temperature be 710° C. or higher and 850° C. or lower and the holding time be 5 hours or more and 10 hours or less.

It is possible to use any of all the ordinary welding methods such as arc welding including TIG welding and MIG welding, electric resistance welding such as seam welding and spot welding, and laser welding, for welding of the stainless steel.

EXAMPLE 1

Stainless steels having the chemical compositions given in Table 1 were prepared by using a vacuum melting method in a laboratory. The prepared steel ingots were heated to a temperature of 1200° C. and subjected to hot rolling including hot rough rolling in which at least one rolling pass is performed with a rolling reduction of 30% or more in a temperature range higher than 900° C. to obtain a hot-rolled steel sheet having a thickness of 5 mm. The obtained hot-rolled steel sheet was subjected to annealing at a temperature of 780° C. for 10 hours and then subjected to descaling by using shot blasting and pickling. The annealing condition was selected so that a martensite phase fraction was 5% or more and 95% or less in our examples.

TABLE 1

| | mass % | | | | | | | | | | | | | | | | |
|---|---|---|---|---|---|---|---|---|---|---|---|---|---|---|---|---|---|
| No. | C | Si | Mn | P | S | Al | Cr | Ni | V | Nb | Ti | N | Other Chemical Elements | Relational Expression (I)*1 | Relational Expression (II)*2 | Martensite Phase Fraction (%) | Note |
| 1 | 0.010 | 0.27 | 1.05 | 0.02 | 0.001 | 0.03 | 10.4 | 1.2 | 0.02 | 0.21 | 0.01 | 0.017 | | 10.8 | 2.5 | 37.2 | Example |
| 2 | 0.011 | 0.30 | 1.90 | 0.02 | 0.001 | 0.03 | 10.4 | 1.1 | 0.02 | 0.16 | 0.01 | 0.017 | | 10.9 | 2.9 | 42.9 | Example |
| 3 | 0.012 | 0.32 | 2.31 | 0.03 | 0.001 | 0.03 | 10.6 | 1.3 | 0.03 | 0.17 | 0.01 | 0.018 | | 11.1 | 3.4 | 54.5 | Example |
| 4 | 0.011 | 0.28 | 1.57 | 0.03 | 0.001 | 0.04 | 10.7 | 0.6 | 0.03 | 0.17 | 0.01 | 0.018 | | 11.1 | 2.3 | 28.7 | Example |
| 5 | 0.011 | 0.28 | 1.40 | 0.01 | 0.001 | 0.04 | 10.8 | 2.4 | 0.04 | 0.17 | 0.01 | 0.019 | | 11.2 | 4.0 | 64.2 | Example |
| 6 | 0.012 | 0.16 | 1.02 | 0.03 | 0.001 | 0.04 | 11.0 | 4.5 | 0.02 | 0.15 | 0.01 | 0.018 | | 11.2 | 5.9 | 94.6 | Example |
| 7 | 0.016 | 0.12 | 1.54 | 0.03 | 0.002 | 0.04 | 12.7 | 1.6 | 0.04 | 0.16 | 0.01 | 0.018 | | 12.9 | 3.4 | 47.4 | Example |
| 8 | 0.027 | 0.08 | 1.58 | 0.03 | 0.002 | 0.03 | 12.4 | 1.4 | 0.02 | 0.17 | 0.02 | 0.018 | | 12.5 | 3.5 | 50.9 | Example |
| 9 | 0.015 | 0.09 | 0.12 | 0.02 | 0.002 | 0.03 | 12.3 | 0.8 | 0.02 | 0.18 | 0.02 | 0.026 | | 12.4 | 2.1 | 16.4 | Example |
| 10 | 0.016 | 0.10 | 1.17 | 0.02 | 0.002 | 0.03 | 11.3 | 0.9 | 0.03 | 0.20 | 0.08 | 0.024 | | 11.5 | 2.7 | 32.2 | Example |
| 11 | 0.026 | 0.33 | 0.56 | 0.02 | 0.001 | 0.07 | 11.0 | 2.2 | 0.03 | 0.25 | 0.03 | 0.025 | | 11.5 | 4.0 | 52.7 | Example |
| 12 | 0.021 | 0.32 | 1.17 | 0.02 | 0.001 | 0.06 | 11.0 | 2.4 | 0.07 | 0.08 | 0.02 | 0.024 | | 11.5 | 4.3 | 68.0 | Example |
| 13 | 0.018 | 0.33 | 0.33 | 0.02 | 0.001 | 0.08 | 10.9 | 2.3 | 0.06 | 0.26 | 0.05 | 0.022 | | 11.4 | 3.7 | 51.9 | Example |
| 14 | 0.014 | 0.34 | 1.26 | 0.02 | 0.001 | 0.09 | 11.0 | 1.7 | 0.02 | 0.37 | 0.01 | 0.023 | | 11.5 | 3.4 | 43.8 | Example |
| 15 | 0.014 | 0.36 | 1.27 | 0.02 | 0.001 | 0.01 | 11.0 | 1.8 | 0.03 | 0.22 | 0.01 | 0.022 | Cu: 0.2 | 11.5 | 3.5 | 54.8 | Example |
| 16 | 0.013 | 0.31 | 1.87 | 0.03 | 0.001 | 0.02 | 11.7 | 1.8 | 0.03 | 0.23 | 0.01 | 0.022 | MO: 0.8 | 12.2 | 3.8 | 56.0 | Example |
| 17 | 0.023 | 0.31 | 1.88 | 0.03 | 0.001 | 0.02 | 11.8 | 0.7 | 0.03 | 0.24 | 0.01 | 0.022 | W: 0.3 | 12.3 | 3.0 | 38.4 | Example |
| 18 | 0.011 | 0.32 | 1.88 | 0.03 | 0.002 | 0.01 | 11.8 | 0.9 | 0.02 | 0.17 | 0.01 | 0.018 | Co: 0.05 | 12.3 | 2.7 | 39.7 | Example |
| 19 | 0.008 | 0.28 | 1.95 | 0.02 | 0.001 | 0.08 | 11.9 | 1.0 | 0.04 | 0.12 | 0.01 | 0.018 | Sn: 0.2 | 12.3 | 2.8 | 40.3 | Example |
| 20 | 0.016 | 0.29 | 1.75 | 0.02 | 0.001 | 0.10 | 12.0 | 2.6 | 0.04 | 0.16 | 0.02 | 0.017 | Ca: 0.0014 | 12.4 | 4.5 | 64.6 | Example |
| 21 | 0.014 | 0.36 | 1.56 | 0.03 | 0.001 | 0.11 | 12.0 | 3.1 | 0.04 | 0.18 | 0.01 | 0.017 | B: 0.0007 | 12.5 | 4.8 | 69.0 | Example |
| 22 | 0.015 | 0.37 | 1.54 | 0.03 | 0.001 | 0.09 | 11.5 | 3.2 | 0.02 | 0.24 | 0.01 | 0.016 | Mg: 0.0031 | 12.1 | 4.9 | 73.2 | Example |
| 23 | 0.019 | 0.21 | 1.34 | 0.03 | 0.001 | 0.08 | 11.5 | 3.0 | 0.03 | 0.26 | 0.01 | 0.014 | REM: 0.01 | 11.8 | 4.7 | 71.0 | Example |
| 24 | 0.021 | 0.22 | 1.36 | 0.02 | 0.001 | 0.08 | 11.4 | 2.8 | 0.02 | 0.25 | 0.01 | 0.012 | Cu: 0.4, Sn: 0.1 | 11.7 | 4.5 | 68.6 | Example |
| 25 | 0.022 | 0.21 | 1.38 | 0.03 | 0.001 | 0.07 | 11.3 | 2.6 | 0.03 | 0.26 | 0.01 | 0.011 | Mo: 0.5, B: 0.0007 | 11.6 | 4.3 | 66.3 | Example |
| 26 | 0.013 | 0.21 | 1.27 | 0.03 | 0.002 | 0.08 | 11.2 | 2.7 | 0.03 | 0.26 | 0.01 | 0.013 | Co: 0.1, Mg: 0.001, REM: 0.008 | 11.5 | 4.1 | 64.3 | Example |
| 27 | 0.016 | 0.13 | 1.22 | 0.02 | 0.001 | 0.09 | 11.5 | 1.4 | 0.03 | 0.18 | 0.24 | 0.018 | | 11.7 | 3.0 | 46.6 | Comparative Example |
| 28 | 0.016 | 0.16 | 3.19 | 0.02 | 0.002 | 0.09 | 11.5 | 1.2 | 0.03 | 0.18 | 0.01 | 0.018 | | 11.7 | 3.8 | 58.5 | Comparative Example |
| 29 | 0.017 | 0.15 | 1.22 | 0.02 | 0.001 | 0.12 | 18.0 | 1.3 | 0.04 | 0.24 | 0.01 | 0.018 | | 18.2 | 3.0 | 0.0 | Comparative Example |
| 30 | 0.016 | 0.14 | 1.72 | 0.02 | 0.001 | 0.08 | 10.7 | 6.6 | 0.04 | 0.23 | 0.01 | 0.018 | | 10.9 | 8.5 | 100.0 | Comparative Example |
| 31 | 0.059 | 0.14 | 1.46 | 0.02 | 0.001 | 0.10 | 10.8 | 1.0 | 0.03 | 0.22 | 0.01 | 0.037 | | 11.0 | 4.6 | 75.4 | Comparative Example |

TABLE 1-continued

| No. | C | Si | Mn | P | S | Al | Cr | Ni | V | Nb | Ti | N | Other Chemical Elements | Relational Expression (I)*1 | Relational Expression (II)*2 | Martensite Phase Fraction (%) | Note |
|---|---|---|---|---|---|---|---|---|---|---|---|---|---|---|---|---|---|
| | mass % | | | | | | | | | | | | | | | | |
| 32 | 0.011 | 0.08 | 1.62 | 0.02 | 0.001 | 0.07 | 10.1 | 1.7 | 0.04 | 0.19 | 0.01 | 0.019 | | 10.2 | 3.4 | 97.1 | Comparative Example |
| 33 | 0.012 | 0.51 | 1.78 | 0.02 | 0.001 | 0.06 | 12.8 | 1.7 | 0.04 | 0.18 | 0.01 | 0.019 | | 13.6 | 3.5 | 3.2 | Comparative Example |
| 34 | 0.011 | 0.20 | 0.16 | 0.02 | 0.001 | 0.07 | 11.5 | 0.4 | 0.05 | 0.19 | 0.01 | 0.018 | | 11.8 | 1.4 | 0.0 | Comparative Example |
| 35 | 0.013 | 0.19 | 2.04 | 0.03 | 0.001 | 0.05 | 11.7 | 4.9 | 0.05 | 0.20 | 0.01 | 0.017 | | 12.0 | 6.8 | 100.0 | Comparative Example |
| 36 | 0.018 | 0.24 | 1.88 | 0.03 | 0.001 | 0.03 | 11.0 | 0.9 | 0.00 | 0.01 | 0.06 | 0.022 | | 11.4 | 3.0 | 100.0 | Comparative Example |
| S1 | 0.013 | 0.19 | 1.54 | 0.03 | 0.001 | 0.04 | 9.1 | 1.8 | 0.03 | 0.20 | 0.02 | 0.019 | | 9.4 | 3.5 | 97.7 | Comparative Example |
| S2 | 0.013 | 0.21 | 1.82 | 0.03 | 0.001 | 0.04 | 11.9 | 1.5 | 0.19 | 0.18 | 0.01 | 0.015 | | 12.2 | 3.3 | 47.9 | Comparative Example |
| S3 | 0.012 | 0.18 | 1.99 | 0.02 | 0.001 | 0.05 | 10.7 | 2.1 | 0.02 | 0.52 | 0.01 | 0.018 | | 11.0 | 4.0 | 55.5 | Comparative Example |

*1 Cr + 1.5 × Si

*2 30 × (C + N) + Ni + 0.5 × Mn

An L-cross section (vertical cross section parallel to the rolling direction) having a shape of 20 mm×10 mm was taken from the descaled hot-rolled steel sheet described above, and the microstructure thereof was exposed by using royal water to observe the microstructure. From the observed microstructure, the average grain diameter of each sample was determined by using a method of section. The specific method of determining an average grain diameter is as follows. The photographs of five fields of view were obtained in the exposed microstructure of the cross section by using an optical microscope at a magnification of 100 times. By drawing five line segments each were drawn in the vertical and horizontal directions in the obtained photographs, and by dividing the total length of the line segments by the number of grain boundaries which were passed through by the line segments, an average grain diameter was defined as the divided result. Determination of a grain diameter was performed without particularly distinguishing ferrite grains from martensite grains. The average grain diameter of each sample is given in Table 2.

Figure 7:
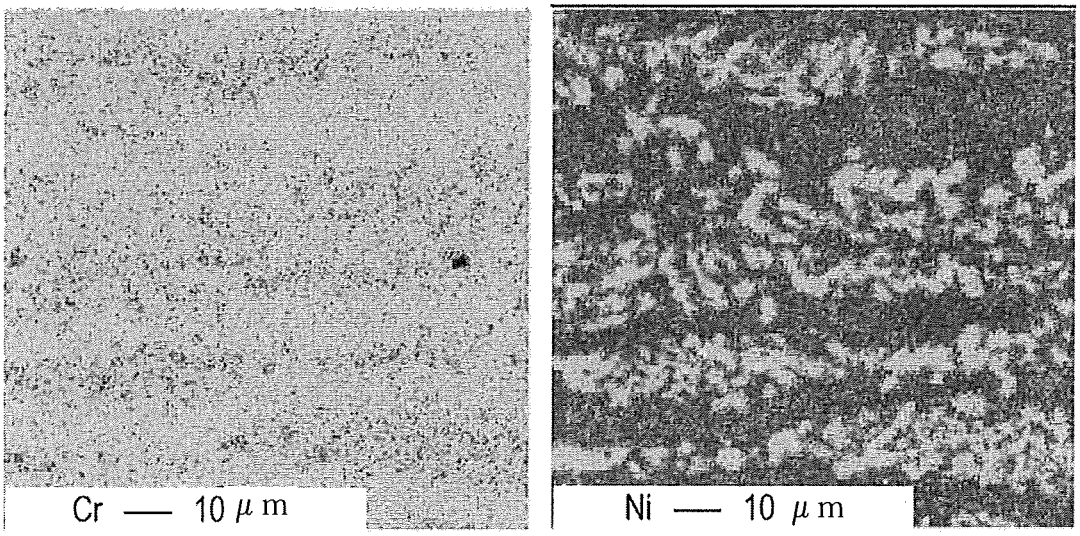
FIG. 7 is a diagram indicating an example of the chemical element distribution of a hot-rolled steel sheet determined by using an EPMA (electron probe microanalyzer).

Moreover, chemical element distributions of Ni and Cr in the L-cross section were determined by using an EPMA (electron probe microanalyzer). An example of the determination is illustrated in FIG. 7. A region in which the Ni concentration is high (looking lighter in the photograph) and the Cr concentration is low (looking darker in the photograph) was judged as corresponding to a martensite phase. Since, in a region occupied by an austenite phase at a heating temperature before hot rolling is performed and at an annealing temperature, the austenite phase stabilizing chemical elements (such as Ni and Mn) are concentrated, and since the ferrite phase stabilizing chemical elements (such as Cr) are depleted, there are differences in the concentrations of some chemical elements between an austenite phase and a ferrite phase. Since a region occupied by an austenite phase at an annealing temperature transforms into one which is occupied by a martensite phase in a following cooling process, Ni is concentrated and Cr is depleted in a martensite phase. Therefore, a region in which the concentrated Ni and the depleted Cr were recognized by using an EPMA was judged as a region which was occupied by a martensite phase. By using the Ni concentration distribution determined by using an EPMA, and by using image analysis, the area of regions looking lighter was determined to determine a martensite phase fraction. The results are given in Table 1. We found that there is a tendency for a martensite phase fraction to increase with increasing value of 30×(C+N)+Ni+0.5×Mn in relational expression (II).

Moreover, the microstructure of ten fields of view in an area of 400 μm square was observed by using an optical microscope. In the microstructure thus observed, an inclusion having a cubic shape a side length of which is 1 μm or more is judged to be TiN, and by counting the number of such inclusions, the number of TiN per 1 $mm^2$ was calculated. The results are given in Table 2. In our examples, the number density of TiN having a side length of 1 μm or more was 70 particles/$mm^2$ or less. The number density of 40 particles/$mm^2$ or less is preferable.

A Charpy test was conducted at a temperature of −50° C. on three Charpy test pieces in the C-direction (direction at a right angle to the rolling direction) taken from each of the descaled hot-rolled steel sheet. The Charpy test piece was a sub-size test piece having a thickness of 5 mm, a width of 55 mm, and a length of 10 mm. The test was performed three times for each sample to obtain an average absorbed energy. The obtained absorbed energy is given in Table 2. In all our examples, the absorbed energy was 25 J or more, which means that satisfactory low-temperature toughness was achieved. In contrast, among the Comparative Examples, since the Ti content of No. 27, the Mn content of No. 28, the Cr content of No. 29, the Ni content of No. 30, the C content and the N content of No. 31, and the Nb content and the V content of No. 36 were respectively out of our ranges, the low-temperature toughness was lower than 25 J in terms of absorbed energy. In addition, in Comparative Examples No. 32 through 35 and No. S1 where relational expression (I) or relational expression (II) was not satisfied, the low-temperature toughness was lower than 25 J in terms of absorbed energy.

A salt spray test was conducted on a test piece of 60 mm×80 mm which was prepared by taking the test piece from the descaled hot-rolled steel sheet and by covering the back surface and edge areas within 5 mm thereof with a water-resistant tape. The salt water concentration was 5%-NaCl, the testing temperature was 35° C., and the testing time was 24 hours. After the salt spray test had been conducted, by taking the photograph of the testing surface and by converting a region with rust into a black region and converting a region without rust into a white region in the photograph, a corrosion area ratio was determined by using image analysis. The obtained corrosion area ratio is given in table 2. When the corrosion area ratio was 15% or less, it was judged as satisfactory corrosion resistance. In all our Examples, that is, No. 1 through No. 26, satisfactory corrosion resistance was achieved. Among the Comparative Examples, in No. 28 where the Mn content was out of our range, in No. 31 where the C content and the N content were out of our ranges, in No. 36 where the Nb content and the V content were out of our ranges, in No. S1 where the Cr content is out of our range, and in No. S2 where the V content is out of our range, satisfactory corrosion resistance was not achieved.

A tensile test was conducted on a JIS No. 5 tensile test piece which was taken in the direction parallel to the rolling direction from the descaled hot-rolled steel sheet to evaluate workability. The obtained values of elongation are given in Table 2. When elongation was 15.0% or more, it was judged as satisfactory workability. In all our Examples, that is, No. 1 through No. 26, satisfactory workability was achieved. Among the Comparative Examples, in No. 30 where the Ni content was out of our range, in No. 31 where the C content and the N content were out of our ranges, in No. 35 where relational expression (II) was not satisfied, in No. 36 where the Nb content and the V content were out of our ranges, and in No. S3 where the Nb content was out of our range, satisfactory workability was not achieved.

From the results described above, it is clarified that, it is possible to obtain ferrite-martensite dual-phase stainless steel excellent in terms of low-temperature toughness.

TABLE 2

| No. | Average Grain Diameter μm | TiN Density particles/mm$^2$ | Absorbed Energy at −50° .C J | Corrosion Area Ratio after SST % | Tensile Elongation % | Note |
|---|---|---|---|---|---|---|
| 1 | 7.8 | 2.9 | 56.3 | 11.6 | 28.9 | Example |
| 2 | 7.5 | 2.9 | 64.4 | 13.4 | 26.0 | Example |
| 3 | 7.3 | 3.1 | 70.4 | 13.9 | 22.7 | Example |
| 4 | 8.2 | 3.1 | 46.0 | 13.0 | 30.4 | Example |
| 5 | 7.3 | 3.2 | 71.9 | 10.8 | 17.9 | Example |
| 6 | 9.0 | 3.1 | 26.2 | 7.7 | 15.1 | Example |
| 7 | 7.5 | 3.1 | 63.7 | 10.1 | 26.3 | Example |
| 8 | 7.4 | 6.1 | 66.1 | 11.2 | 24.6 | Example |
| 9 | 8.7 | 8.8 | 30.2 | 8.8 | 31.8 | Example |
| 10 | 7.8 | 32.6 | 35.8 | 11.7 | 28.9 | Example |
| 11 | 7.3 | 12.8 | 57.3 | 10.0 | 18.6 | Example |
| 12 | 7.3 | 8.2 | 68.6 | 10.7 | 16.0 | Example |
| 13 | 7.3 | 18.7 | 45.7 | 9.1 | 21.1 | Example |
| 14 | 7.3 | 3.9 | 69.9 | 11.3 | 23.1 | Example |
| 15 | 7.3 | 3.7 | 70.6 | 11.2 | 22.6 | Example |
| 16 | 7.3 | 3.7 | 71.2 | 11.6 | 22.0 | Example |
| 17 | 7.7 | 3.7 | 58.9 | 13.1 | 28.1 | Example |
| 18 | 7.9 | 3.1 | 52.1 | 12.2 | 30.1 | Example |
| 19 | 7.9 | 3.1 | 53.0 | 12.0 | 29.9 | Example |
| 20 | 7.3 | 5.8 | 70.3 | 10.2 | 17.7 | Example |
| 21 | 7.4 | 2.9 | 69.4 | 9.3 | 16.4 | Example |
| 22 | 7.5 | 2.7 | 65.5 | 9.6 | 15.2 | Example |
| 23 | 7.4 | 2.4 | 67.7 | 9.5 | 16.1 | Example |
| 24 | 7.3 | 2.0 | 69.7 | 9.8 | 16.7 | Example |
| 25 | 7.3 | 1.9 | 71.1 | 10.2 | 16.8 | Example |
| 26 | 7.3 | 2.2 | 71.9 | 9.7 | 17.8 | Example |
| 27 | 7.6 | 73.4 | 4.2 | 10.9 | 26.7 | Comparative Example |
| 28 | 7.3 | 3.1 | 12.7 | 20.1 | 20.8 | Comparative Example |
| 29 | 12.8 | 3.1 | 5.1 | 4.5 | 32.3 | Comparative Example |
| 30 | 10.8 | 3.1 | 13.2 | 7.5 | 12.7 | Comparative Example |
| 31 | 7.6 | 6.3 | 15.9 | 16.0 | 14.5 | Comparative Example |
| 32 | 10.3 | 3.2 | 13.7 | 12.6 | 15.7 | Comparative Example |
| 33 | 10.7 | 3.1 | 13.0 | 10.3 | 26.6 | Comparative Example |
| 34 | 11.5 | 3.1 | 10.4 | 9.6 | 31.7 | Comparative Example |
| 35 | 13.1 | 3.0 | 4.8 | 8.7 | 12.2 | Comparative Example |
| 36 | 11.4 | 21.6 | 5.6 | 17.1 | 10.8 | Comparative Example |
| S1 | 10.6 | 4.8 | 12.9 | 26.0 | 15.4 | Comparative Example |
| S2 | 7.5 | 3.1 | 66.7 | 16.6 | 24.1 | Comparative Example |
| S3 | 7.3 | 3.2 | 30.5 | 8.9 | 11.3 | Comparative Example |

EXAMPLE 2

Steel slabs having the chemical compositions given in Table 3 and a thickness of 250 mm were prepared by using a vacuum melting method. The prepared steel slabs were heated to a temperature of 1200° C. and then subjected to 9-pass hot-rolling to obtain hot-rolled steel sheets having a thickness of 5 mm. The conditions of hot rolling including rough rolling are given in Table 4. The obtained hot-rolled steel sheets were subjected to annealing under the conditions given in Table 4 and then descaled by using shot blasting and pickling.

TABLE 3

| | mass % | | | | | | | | | | | | | | |
|---|---|---|---|---|---|---|---|---|---|---|---|---|---|---|---|
| No. | C | Si | Mn | P | S | Al | Cr | Ni | V | Nb | Ti | N | Relational Expression (I)*1 | Relational Expression (II)*2 | Note |
| 37 | 0.011 | 0.35 | 1.88 | 0.02 | 0.001 | 0.07 | 11.1 | 1.0 | 0.05 | 0.22 | 0.01 | 0.018 | 11.6 | 2.8 | Example |

*1 Cr + 1.5 × Si

*2 30 × (C + N) + Ni + 0.5 × Mn

An L-cross section having a shape of 20 mm×10 mm was taken from the descaled hot-rolled steel sheet described above, and the microstructure thereof was exposed by using royal water to observe the microstructure. From the observed microstructure, the average grain diameter of each sample was determined by using a method of section. The average grain diameter of each sample is given in Table 4.

Moreover, chemical element distribution of Ni in the L-cross section (vertical cross section parallel to the rolling direction) was determined by using an EPMA. By judging a region in which Ni was concentrated as a region which was occupied by martensite, a martensite phase fraction was determined by using image analysis. The results are given in Table 4.

Moreover, the microstructure of ten fields of view in an area of 400 μm square was observed by using an optical microscope. In the microstructure observed, by judging an inclusion having a cubic shape a side length of which is 1 μm or more as TiN, and by counting the number of such inclusions, the number of TiN per 1 $mm^2$ was calculated. The results are given in Table 4.

A Charpy test was conducted at a temperature of −50° C. on three Charpy test pieces in the C-direction (direction at a right angle to the rolling direction) taken from each of the descaled hot-rolled steel sheet. The Charpy test piece was a sub-size test piece having a thickness of 5 mm, a width of 55 mm, and a length of 10 mm. The test was performed three times for each sample to obtain an average absorbed energy. The obtained absorbed energy is given in Table 4. In all our Examples, the absorbed energy was 25 J or more, which means that satisfactory low-temperature toughness was achieved. In Comparative Examples No. D and No. E where the maximum rolling reduction at a temperature higher than 900° C. was 30% or less, since the average grain diameter was large even though the maximum rolling reduction was 30% or more at a temperature of 900° C. or lower, the absorbed energy at a temperature of −50° C. was 25 J or less. In Comparative Example No. F where the annealing temperature was low, since the martensite phase fraction was less than 5%, the absorbed energy at a temperature of −50° C. was 25 J or less. In Comparative Example No. J where the annealing temperature was high, since the martensite phase fraction was more than 95%, the absorbed energy at a temperature of −50° C. was 25 J or less. In Comparative Example No. K where the annealing time was less than one hour, since the degrees of transformation and recrystallization induced by annealing were insufficient, it was not possible to determine a martensite phase fraction or an average grain diameter and, as a result, the absorbed energy of No. K at a temperature of −50° C. was 25 J or less.

A salt spray test was conducted on a test piece of 60 mm×80 mm which was prepared by taking the test piece from the descaled hot-rolled steel sheet and by covering the back surface and edge areas within 5 mm thereof with a water-resistant tape. The salt water concentration was 5%-NaCl, the testing temperature was 35° C., and the testing time was 24 hours. After the salt spray test had been conducted, by taking the photograph of the testing surface and by converting a region with rust into a black region and converting a region without rust into a white region on the photograph, a corrosion area ratio was determined by using image analysis. The obtained corrosion area ratio is given in Table 4. When the corrosion area ratio was 15% or less, it was judged as satisfactory corrosion resistance. In all our Examples, satisfactory corrosion resistance was achieved. Among the Comparative Examples, in No. J where the annealing temperature was high and in No. K where annealing was insufficiently performed, satisfactory corrosion resistance was not achieved.

A tensile test was conducted on a JIS No. 5 tensile test piece which was taken in the direction parallel to the rolling direction from the descaled hot-rolled steel sheet to evaluate workability. The obtained values of elongation are given in Table 4. When elongation was 15.0% or more, it was judged as satisfactory workability. In all our Examples, satisfactory workability was achieved. Among the Comparative Examples, in No. J where the martensite phase fraction was large and in No. K where annealing was insufficiently performed, satisfactory workability was not achieved.

From the results described above, it is possible to obtain ferrite-martensite dual-phase stainless steel excellent in terms of low-temperature toughness.

TABLE 4

| | Hot Rolling Condition | | | | | | | | | | |
|---|---|---|---|---|---|---|---|---|---|---|---|
| | Maximum Rolling Reduction | Maximum Rolling Reduction | Annealing Condition | | Average | Martensite | TiN | Absorbed | Corrosion | | |
| Test No. | above 900° C. % | at or below 900° C. % | Annealing Temperature ° C. | Time h | Grain Diameter μm | Phase Fraction % | Density particles/ $mm^2$ | Energy at −50° C. J | Area Ratio after SST % | Tensile Elongation % | Note |
| A | 40 | 20 | 750 | 6 | 7.6 | 34.8 | 3.1 | 63.4 | 12.8 | 28.2 | Example |
| B | 35 | 25 | 750 | 6 | 7.9 | 34.9 | 3.1 | 54.7 | 13.5 | 28.4 | Example |
| C | 32 | 27 | 750 | 6 | 8.5 | 34.8 | 3.0 | 38.3 | 12.4 | 28.6 | Example |

TABLE 4-continued

| Test No. | Hot Rolling Condition: Maximum Rolling Reduction above 900° C. % | Hot Rolling Condition: Maximum Rolling Reduction at or below 900° C. % | Annealing Condition: Annealing Temperature ° C. | Annealing Condition: Time h | Average Grain Diameter μm | Martensite Phase Fraction % | TiN Density particles/mm$^2$ | Absorbed Energy at −50° C. J | Corrosion Area Ratio after SST % | Tensile Elongation % | Note |
|---|---|---|---|---|---|---|---|---|---|---|---|
| D | 25 | 30 | 750 | 6 | 10.1 | 35.1 | 3.1 | 12.6 | 12.7 | 29.0 | Comparative Example |
| E | 20 | 35 | 750 | 6 | 10.8 | 35.0 | 3.1 | 9.5 | 12.9 | 29.4 | Comparative Example |
| F | 35 | 20 | 670 | 6 | 10.9 | 0 | 3.1 | 4.8 | 13.1 | 33.1 | Comparative Example |
| G | 35 | 20 | 720 | 6 | 8.1 | 28.5 | 3.2 | 49.2 | 13.0 | 30.6 | Example |
| H | 35 | 20 | 800 | 6 | 7.9 | 42.1 | 3.1 | 54.7 | 12.8 | 28.0 | Example |
| I | 35 | 20 | 880 | 6 | 7.8 | 67.4 | 3.0 | 57.6 | 12.9 | 25.1 | Example |
| J | 35 | 20 | 950 | 6 | 10.7 | 99.2 | 3.0 | 11.4 | 16.4 | 13.3 | Comparative Example |
| K | 35 | 20 | 780 | 0.5 | — | — | 3.1 | 5.3 | 19.2 | 12.6 | Comparative Example |

EXAMPLE 3

Stainless steels having the chemical compositions given in Table 5 were prepared by using a vacuum melting method in a laboratory. The prepared steel ingots were heated to a temperature of 1200° C. and subjected to hot rolling including hot rough rolling in which at least one rolling pass was performed with a rolling reduction of 30% or more in a temperature range higher than 900° C. to obtain a hot-rolled steel sheet having a thickness of 5 mm. The obtained hot-rolled steel sheet was subjected to annealing at a temperature of 780° C. for 10 hours and then subjected to descaling by using shot blasting and pickling.

TABLE 5

| No. | C (mass %) | Si | Mn | P | S | Al | Cr | Ni | V | Nb | Ti | N |
|---|---|---|---|---|---|---|---|---|---|---|---|---|
| 38 | 0.008 | 0.20 | 1.13 | 0.035 | 0.002 | 0.07 | 11.5 | 0.8 | 0.08 | 0.10 | 0.008 | 0.011 |
| 49 | 0.026 | 0.18 | 1.50 | 0.033 | 0.002 | 0.04 | 11.0 | 0.7 | 0.05 | 0.15 | 0.005 | 0.010 |
| 40 | 0.011 | 0.07 | 2.33 | 0.030 | 0.002 | 0.06 | 10.8 | 0.6 | 0.07 | 0.13 | 0.004 | 0.012 |
| 41 | 0.013 | 0.43 | 1.87 | 0.028 | 0.002 | 0.06 | 12.1 | 0.4 | 0.03 | 0.12 | 0.009 | 0.009 |
| 42 | 0.012 | 0.14 | 1.61 | 0.024 | 0.002 | 0.05 | 11.8 | 0.9 | 0.04 | 0.14 | 0.007 | 0.009 |
| 43 | 0.010 | 0.19 | 2.47 | 0.022 | 0.002 | 0.04 | 11.7 | 0.8 | 0.05 | 0.24 | 0.006 | 0.010 |
| 44 | 0.018 | 0.25 | 1.15 | 0.031 | 0.002 | 0.04 | 11.3 | 0.8 | 0.07 | 0.20 | 0.005 | 0.013 |
| 45 | 0.017 | 0.27 | 2.28 | 0.032 | 0.002 | 0.05 | 12.9 | 0.9 | 0.04 | 0.17 | 0.005 | 0.010 |
| 46 | 0.016 | 0.22 | 1.64 | 0.033 | 0.002 | 0.06 | 10.2 | 0.3 | 0.05 | 0.21 | 0.004 | 0.014 |
| 47 | 0.015 | 0.18 | 1.73 | 0.032 | 0.002 | 0.10 | 11.6 | 0.5 | 0.07 | 0.19 | 0.015 | 0.012 |
| 48 | 0.013 | 0.17 | 2.02 | 0.031 | 0.003 | 0.12 | 12.8 | 0.7 | 0.05 | 0.09 | 0.011 | 0.010 |
| 49 | 0.017 | 0.31 | 1.39 | 0.036 | 0.003 | 0.11 | 10.6 | 1.0 | 0.04 | 0.21 | 0.007 | 0.008 |
| 50 | 0.017 | 0.13 | 1.99 | 0.012 | 0.002 | 0.06 | 10.6 | 1.0 | 0.04 | 0.16 | 0.003 | 0.011 |
| 51 | 0.020 | 0.26 | 1.43 | 0.037 | 0.003 | 0.05 | 11.1 | 0.6 | 0.04 | 0.13 | 0.035 | 0.009 |
| 52 | 0.023 | 0.15 | 0.51 | 0.028 | 0.003 | 0.05 | 10.9 | 0.9 | 0.05 | 0.15 | 0.007 | 0.007 |
| 53 | 0.015 | 0.16 | 1.35 | 0.029 | 0.003 | 0.06 | 11.7 | 0.9 | 0.08 | 0.16 | 0.006 | 0.025 |
| 54 | 0.013 | 0.20 | 1.74 | 0.032 | 0.002 | 0.06 | 11.8 | 1.5 | 0.08 | 0.16 | 0.003 | 0.010 |
| 55 | 0.015 | 0.24 | 2.16 | 0.030 | 0.002 | 0.06 | 11.9 | 0.8 | 0.07 | 0.31 | 0.005 | 0.010 |
| 56 | 0.012 | 0.32 | 1.12 | 0.030 | 0.002 | 0.10 | 12.7 | 0.4 | 0.09 | 0.18 | 0.005 | 0.011 |

| No. | Other Chemical Elements | Relational Expression (I)*1 | Relational Expression (II)*2 | Martensite Phase Fraction (%) | Relational Expression (III) | Note |
|---|---|---|---|---|---|---|
| 38 | | 11.8 | 1.9 | 29.5 | 1298 | Example |
| 49 | | 11.3 | 2.5 | 40.4 | 1366 | Example |
| 40 | | 10.9 | 2.5 | 40.5 | 1352 | Example |
| 41 | | 12.7 | 2.0 | 28.2 | 1274 | Example |
| 42 | | 12.0 | 2.3 | 35.0 | 1309 | Example |
| 43 | | 12.0 | 2.6 | 39.9 | 1321 | Example |
| 44 | | 11.7 | 2.3 | 35.5 | 1335 | Example |
| 45 | | 13.3 | 2.9 | 38.6 | 1290 | Example |
| 46 | Mo: 1.2, Co: 0.05 | 10.5 | 2.0 | 34.5 | 1361 | Example |
| 47 | W: 0.5, Cu: 0.2 | 11.9 | 2.2 | 33.0 | 1311 | Example |
| 48 | Ca: 0.002, Mg: 0.002 | 13.1 | 2.4 | 33.1 | 1271 | Example |
| 49 | B: 0.001, REM: 0.002 | 11.1 | 2.4 | 39.8 | 1365 | Example |
| 50 | | 10.8 | 2.8 | 47.3 | 1386 | Example |
| 51 | | 11.5 | 2.2 | 34.2 | 1337 | Example |

TABLE 5-continued

| | mass % | | | | |
|---|---|---|---|---|---|
| 52 | 11.1 | 2.1 | 31.2 | 1348 | Example |
| 53 | 11.9 | 2.8 | 41.8 | 1342 | Example |
| 54 | 12.1 | 3.1 | 60.4 | 1345 | Example |
| 55 | 12.3 | 2.6 | 38.6 | 1318 | Example |
| 56 | 13.2 | 1.7 | 10.5 | 1238 | Example |

An underlined portion indicates a value out of our range.
*1 Cr + 1.5 × Si
*2 30 × (C + N) + Ni + 0.5 × Mn An L-cross section (vertical cross section parallel to the rolling direction) having a shape of 20 mm×10 mm was taken from these descaled hot-rolled and annealed steel sheet described above, and the microstructure thereof was exposed by using royal water to observe the microstructure. From the observed microstructure, the average grain diameter of each sample was determined by using a method of section. The average grain diameter of each sample is given in Table 6.

Moreover, chemical element distribution of Ni in the L-cross section (vertical cross section parallel to the rolling direction) was determined by using an EPMA. By judging a region in which Ni was concentrated as a region which was occupied by martensite, a martensite phase fraction was determined by using image analysis. The results are given in Table 5.

Moreover, the microstructure of ten fields of view in an area of 400 μm square was observed by using an optical microscope. In the microstructure observed, by judging an inclusion having a cubic shape a side length of which is 1 μm or more as TiN, and by counting the number of such inclusions, the number of TiN per 1 $mm^2$ was calculated. The results are given in Table 6.

A Charpy test was conducted at a temperature of −50° C. on three Charpy test pieces in the C-direction (direction at a right angle to the rolling direction) taken from each of the descaled hot-rolled steel sheet. The Charpy test piece was a sub-size test piece having a thickness of 5 mm, a width of 55 mm, and a length of 10 mm. The test was performed three times for each sample to obtain an average absorbed energy. The obtained absorbed energy is given in Table 6. In all of No. 38 through No. 56 in Table 6, the absorbed energy was 25 J or more, which means that satisfactory low-temperature toughness was achieved.

A salt spray test was conducted on a test piece of 60 mm×80 mm which was prepared by taking the test piece from the descaled hot-rolled steel sheet and by covering the back surface and edge areas within 5 mm thereof with a water-resistant tape. The salt water concentration was 5%-NaCl, the testing temperature was 35° C., and the testing time was 24 hours. After the salt spray test had been conducted, by taking the photograph of the testing surface and by converting a region with rust into a black region and converting a region without rust into a white region on the photograph, a corrosion area ratio was determined by using image analysis. The obtained corrosion area ratio is given in Table 6. In all of No. 38 through No. 56 in Table 6, the corrosion area ratio was 15% or less, which means that satisfactory corrosion resistance was achieved.

A tensile test was conducted on a JIS No. 5 tensile test piece which was taken in the direction parallel to the rolling direction from the descaled hot-rolled steel sheet to evaluate workability. The obtained values of elongation are given in Table 6. In all of No. 38 through No. 56 in Table 6, the elongation was 15.0% or more, which means that satisfactory workability was achieved.

A test piece of 300 mm×100 mm was taken from the descaled hot-rolled steel sheet, and an end surface on the side having a length of 300 mm was machined with the edge angles being decreased by 30° to form a V-shaped groove having a grove angle of 60° when facing another test piece. The machined end surfaces were welded with the surfaces facing each other by using MIG welding with a heat input of 0.7 kJ/mm and a welding speed of 60 cm/min. The shielding gas was 100%-Ar. The welding wire was Y309L (JIS Z 3321) having a diameter of 1.2 mmϕ. The welding direction was the L-direction.

A sub-size Charpy test piece including the weld bead and having a thickness of 5 mm, a width of 55 mm, and a length of 10 mm was prepared. The notch was formed at the position where the proportion of the weld zone to the thickness was 50%. The notch shape was a 2 mm V-notch. A Charpy impact test was performed 9 times at a temperature of −50° C.

The minimum value of the absorbed energy obtained by performing a Charpy impact test 9 times is given in Table 6. Since, in all of No. 38 through No. 50 in Table 6, the absorbed energy of a welded heat-affected zone was 10 J or more, satisfactory low-temperature toughness of a welded heat-affected zone was achieved. In particular, in No. 50 where the P content was less than 0.02%, the absorbed energy of a welded heat-affected zone was 50 J or more, which means that outstanding low-temperature toughness of a welded heat-affected zone was achieved. Since the Ti content of No. 51, the Mn content of No. 52, the N content of No. 53, the Ni content of No. 54, the Nb content of No. 55, and the left-hand side value of relational expression (III) of No. 56 were respectively out of our ranges, the absorbed energy of a welded heat-affected zone was less than 10 J, which means that satisfactory low-temperature toughness of a welded heat-affected zone was not achieved.

From the results described above, it is possible to obtain ferrite-martensite dual-phase stainless steel excellent in terms of low-temperature toughness at a welded heat-affected zone.

TABLE 6

| No. | Average Grain Diameter μm | TiN Density particles/ $mm^2$ | Absorbed Energy at −50° .C J | Corrosion Area Ratio after SST % | Tensile Elongation % | Minimum Absorbed Energy of Welded Heat-affected Zone J | Note |
|---|---|---|---|---|---|---|---|
| 38 | 8.8 | 1.5 | 30.9 | 10.7 | 32.2 | 15.6 | Example |
| 39 | 7.9 | 0.9 | 53.3 | 12.7 | 27.8 | 29.2 | Example |
| 40 | 7.9 | 0.8 | 53.2 | 14.2 | 27.7 | 26.4 | Example |
| 41 | 8.9 | 1.4 | 28.1 | 12.1 | 32.9 | 10.8 | Example |
| 42 | 8.3 | 1.1 | 43.1 | 11.4 | 29.5 | 17.8 | Example |
| 43 | 7.9 | 1.0 | 52.3 | 13.3 | 28.1 | 20.3 | Example |
| 44 | 8.2 | 1.1 | 43.6 | 11.4 | 29.3 | 23.0 | Example |
| 45 | 8.0 | 0.9 | 49.9 | 11.8 | 28.7 | 14.1 | Example |
| 46 | 8.3 | 1.0 | 41.4 | 14.0 | 30.7 | 28.2 | Example |
| 47 | 8.4 | 3.1 | 35.5 | 12.4 | 31.5 | 18.3 | Example |
| 48 | 8.4 | 1.9 | 34.0 | 11.5 | 31.5 | 10.2 | Example |
| 49 | 7.9 | 1.0 | 52.5 | 12.2 | 30.1 | 29.1 | Example |
| 50 | 7.5 | 0.6 | 83.4 | 13.5 | 26.4 | 59.4 | Example |
| 51 | 8.3 | 24.7 | 28.5 | 12.3 | 30.9 | 2.8 | Example |
| 52 | 8.6 | 0.8 | 35.4 | 9.9 | 31.4 | 4.2 | Example |
| 53 | 7.8 | 2.6 | 53.4 | 11.7 | 29.1 | 6.1 | Example |
| 54 | 7.3 | 0.5 | 72.4 | 10.1 | 19.8 | 5.5 | Example |
| 55 | 8.0 | 0.9 | 50.0 | 12.6 | 30.7 | 3.9 | Example |
| 56 | 9.5 | 0.9 | 25.6 | 10.1 | 34.2 | 3.6 | Example |

INDUSTRIAL APPLICABILITY

It is possible to obtain ferrite-martensite dual-phase stainless steel excellent in terms of low-temperature toughness which can be manufactured at low cost and with high efficiency and which can preferably be used as a material for the body of a freight car which carries, coal, oil or the like in cold areas and a method of manufacturing the steel.

Moreover, it is possible to obtain ferrite-martensite dual-phase stainless steel to be used as a material for a welded structure excellent also in terms of the low-temperature toughness of a welded heat-affected zone.

The invention claimed is:

1. A ferrite-martensite dual-phase hot rolled and annealed stainless steel, the steel having a chemical composition containing, by mass %, C: 0.005% or more and 0.030% or less,
N: 0.005% or more and 0.026% or less,
Si: 0.05% or more and 1.00% or less,
Mn: 0.05% or more and 2.5% or less,
P: 0.04% or less,
S: 0.02% or less,
Al: 0.01% or more and 0.15% or less,
Cr: 10.0% or more and 13.0% or less,
Ni: 0.3% or more and less than 1.0%,
V: 0.005% or more and 0.10% or less,
Nb: 0.05% or more and 0.4% or less,
Ti: 0.1% or less, and the balance being Fe and inevitable impurities, wherein inequalities (I) and (II) below are satisfied and a microstructure of the hot rolled and annealed stainless steel includes a dual phase of a ferrite phase and a martensite phase, the content of the martensite phase being 5% or more and 95% or less in terms of vol. %:

$$10.5 \leq Cr+1.5\times Si \leq 13.5 \quad (I)$$

$$1.5 \leq 30\times(C+N)+Ni+0.5\times Mn \leq 6.0 \quad (II),$$

where Cr and Si in inequality (I) above and C, N, Ni, and Mn in inequality (II) above respectively represent the contents (mass %) of the corresponding chemical elements, and wherein an absorbed energy at a temperature of −50° C. on a Charpy test is 25 J or more, a corrosion area ratio is 15% or less and an elongation is 15.0% or more.

2. The ferrite-martensite dual-phase hot rolled and annealed stainless steel according to claim 1, comprising a composition of the steel further containing at least one group selected from the groups A to B consisting of:

Group A: one, two, or more of Cu: 1.0% or less, Mo: 1.0% or less, W: 1.0% or less, and Co: 0.5% or less, by mass %

Group B: one, two, or more of Ca: 0.01% or less, B: 0.01% or less, Mg: 0.01% or less, and REM: 0.05% or less, by mass %.

3. The ferrite-martensite dual-phase hot rolled and annealed stainless steel according to claim 1 wherein, by mass %, the N content is 0.005% or more and 0.015% or less,
the Si content is 0.05% or more and 0.50% or less,
the Mn content is more than 1.0% and 2.5% or less,
the Ni content is 0.3% or more and less than 1.0%,
the Nb content is 0.05% or more and 0.25% or less, and
the Ti content is 0.02% or less and
wherein relational expression (III) below is satisfied:

$$2600C+1700N-20Si+20Mn-40Cr+50Ni+1660 \geq 1270 \quad (III),$$

where, C, N, Si, Mn, Cr, and Ni in relational expression (III) respectively represent the contents (mass %) of the corresponding chemical elements.

4. The ferrite-martensite dual-phase hot rolled and annealed stainless steel according to claim 3, wherein, by mass %, the P content is less than 0.02%.

5. The ferrite-martensite dual-phase hot rolled and annealed stainless steel according to claim 3, comprising a composition of the steel further containing at least one group selected from the groups C to D consisting of:

Group C: one, two, or more of Cu: 1.0% or less, Mo: less than 0.5%, W: 1.0% or less, and Co: 0.5% or less, by mass %

Group D: one, two, or more of Ca: 0.01% or less, B: 0.01% or less, Mg: 0.01% or less, and REM: 0.05% or less, by mass %.

6. The ferrite-martensite dual-phase hot rolled and annealed stainless steel according to claim 4, comprising a composition of the steel further containing at least one group selected from the groups C to D consisting of:

Group C: one, two, or more of Cu: 1.0% or less, Mo: less than 0.5%, W: 1.0% or less, and Co: 0.5% or less, by mass %

Group D: one, two, or more of Ca: 0.01% or less, B: 0.01% or less, Mg: 0.01% or less, and REM: 0.05% or less, by mass %.

7. A method of manufacturing the ferrite-martensite dual-phase hot rolled and annealed stainless steel according to claim 1, comprising:

heating a steel slab to a temperature of 1100° C. or higher and 1300° C. or lower;

performing hot rolling including hot rough rolling in which at least one rolling pass is performed with a rolling reduction of 30% or more in a temperature range higher than 900° C.; and performing annealing at a temperature of 700° C. or higher and 900° C. or lower for one hour or more.

8. A method of manufacturing the ferrite-martensite dual-phase hot rolled and annealed stainless steel according to claim 2, comprising:

heating a steel slab to a temperature of 1100° C. or higher and 1300° C. or lower;

performing hot rolling including hot rough rolling in which at least one rolling pass is performed with a rolling reduction of 30% or more in a temperature range higher than 900° C.; and performing annealing at a temperature of 700° C. or higher and 900° C. or lower for one hour or more.

9. A method of manufacturing the ferrite-martensite dual-phase hot rolled and annealed stainless steel according to claim 3, comprising:

heating a steel slab to a temperature of 1100° C. or higher and 1300° C. or lower;

performing hot rolling including hot rough rolling in which at least one rolling pass is performed with a rolling reduction of 30% or more in a temperature range higher than 900° C.; and performing annealing at a temperature of 700° C. or higher and 900° C. or lower for one hour or more.

10. A method of manufacturing the ferrite-martensite dual-phase hot rolled and annealed stainless steel according to claim 4, comprising:

heating a steel slab to a temperature of 1100° C. or higher and 1300° C. or lower;

performing hot rolling including hot rough rolling in which at least one rolling pass is performed with a rolling reduction of 30% or more in a temperature range higher than 900° C.; and performing annealing at a temperature of 700° C. or higher and 900° C. or lower for one hour or more.

11. A method of manufacturing the ferrite-martensite dual-phase hot rolled and annealed stainless steel according to claim 5, comprising:

heating a steel slab to a temperature of 1100° C. or higher and 1300° C. or lower;

performing hot rolling including hot rough rolling in which at least one rolling pass is performed with a rolling reduction of 30% or more in a temperature range higher than 900° C.; and performing annealing at a temperature of 700° C. or higher and 900° C. or lower for one hour or more.

12. A method of manufacturing the ferrite-martensite dual-phase hot rolled and annealed stainless steel according to claim 6, comprising:

heating a steel slab to a temperature of 1100° C. or higher and 1300° C. or lower;

performing hot rolling including hot rough rolling in which at least one rolling pass is performed with a rolling reduction of 30% or more in a temperature range higher than 900° C.; and performing annealing at a temperature of 700° C. or higher and 900° C. or lower for one hour or more.

* * * * *